US006894429B2

(12) United States Patent
Tsuda et al.

(10) Patent No.: US 6,894,429 B2
(45) Date of Patent: May 17, 2005

(54) DISCHARGE LAMP DEVICE

(75) Inventors: Toshiaki Tsuda, Shizuoka (JP); Masato Harazaki, Shizuoka (JP); Masaya Shido, Shizuoka (JP); Kunimasa Mochizuki, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 67 days.

(21) Appl. No.: 10/093,382

(22) Filed: Mar. 11, 2002

(65) Prior Publication Data

US 2002/0130601 A1 Sep. 19, 2002

(30) Foreign Application Priority Data

Mar. 12, 2001 (JP) ..... P2001-068585
Oct. 12, 2001 (JP) ..... P2001-315527

(51) Int. Cl.[7] ..... H01J 1/02
(52) U.S. Cl. ..... 313/318.09; 313/318.1
(58) Field of Search ..... 313/318, 110–113, 313/25, 580, 238, 318.01, 318.02, 318.09, 318.1, 310–313; 439/611, 352–353, 355; 362/285, 288, 255, 311, 369, 396

(56) References Cited

U.S. PATENT DOCUMENTS 4,307,315 A * 12/1981 Meulemans et al. ..... 313/44
5,039,912 A * 8/1991 Van Vliet et al. ..... 313/25
5,126,619 A * 6/1992 Wakimizu et al. ..... 313/25
5,250,872 A * 10/1993 Wakimizu et al. ..... 313/25
5,359,255 A * 10/1994 Kawai et al. ..... 313/17
5,428,261 A * 6/1995 Wittig et al. ..... 313/318.1
5,432,399 A * 7/1995 Nagasawa et al. ..... 313/25
5,506,474 A 4/1996 Hammer et al.
5,578,892 A * 11/1996 Whitman et al. ..... 313/112
5,587,626 A * 12/1996 Parham et al. ..... 313/634
5,702,179 A * 12/1997 Sidwell et al. ..... 362/255
5,742,114 A * 4/1998 Kohl et al. ..... 313/318.01
5,757,110 A * 5/1998 Motiduki et al. ..... 313/25
6,108,126 A * 8/2000 Hagiwara et al. ..... 359/361
6,239,539 B1 5/2001 Mochiduki et al.
6,274,973 B1 * 8/2001 Mochiduki et al. .... 313/318.09
6,294,861 B1 * 9/2001 Mochiduki et al. .... 313/318.01
6,653,764 B2 * 11/2003 Kato et al. ..... 313/25
6,731,076 B1 * 5/2004 Gerhard et al. ..... 315/289
6,752,524 B2 * 6/2004 Becker et al. ..... 362/548

FOREIGN PATENT DOCUMENTS

| | | |
|---|---|---|
| EP | 0 921 553 A2 | 6/1999 |
| EP | 0 935 277 A1 | 8/1999 |
| GB | 2 152 278 | 7/1985 |
| JP | 5-234568 | 9/1993 |
| JP | 11-176318 | 7/1999 |
| JP | 11-176319 | 7/1999 |
| JP | 2001-23427 | 1/2001 |

* cited by examiner

*Primary Examiner*—Joseph Williams
*Assistant Examiner*—Dalei Dong
(74) *Attorney, Agent, or Firm*—Sughrue Mion, PLLC

(57) ABSTRACT

In a discharge lamp device, the arc tube body is configured by welding and integrating shroud glass with an arc tube so as to enclose a discharging portion, and a rearward elongating portion of the arc tube that elongates in the rear of the shroud glass is inserted and held into an opening of an insulating plug which is made of synthetic resin. A UV blocking film is formed on the outer surface of the rearward elongating portion of the arc tube. UV components of leakage light from the rearward elongating portion are cut off, and the amount of ultraviolet rays to which the resin layer in the opening is exposed is reduced. The UV blocking film is in the opening, and hence cannot be seen through a front lens.

6 Claims, 23 Drawing Sheets

FIG. 31

RESULTS OF LIGHTING TESTS

| | | TEST SAMPLES | | | | | |
|---|---|---|---|---|---|---|---|
| | | NOT SHIELDED (CONVENTIONAL DEVICES) | WHOLE OF ROOT PORTION (ALL OF A TO D) IS SHIELDED | ONLY PORTION A IS SHIELDED | ONLY PORTION B IS SHIELDED | ONLY PORTION C IS SHIELDED | ONLY PORTION D IS SHIELDED |
| LIGHTING TIME (h) | 50 | ○ | ○ | ○ | ○ | ○ | ○ |
| | 100 | × | ○ | ○ | ○ | × | ○ |
| | 150 | × | ○ | ○ | ○ | × | × |
| | 200 | × | ○ | ○ | ○ | × | × |
| | 500 | × | ○ | ○ | ○ | × | × |

DISCHARGE LAMP DEVICE

BACKGROUND OF THE INVENTION

1. Field of the Invention

The present invention relates to a discharge lamp device in which an arc tube elongates in the front of an insulating plug made of a synthetic resin, and particularly to a discharge lamp device which includes an arc tube body of a structure where shroud glass is welded and integrated with an arc tube and a discharging portion is enclosed by the shroud glass, and which has a structure where a rearward elongating portion of the arc tube elongating in the rear of the shroud glass is inserted and held into a front opening of an insulating plug made of a synthetic resin.

2. Description of the Related Art

Light emitted from a discharging portion contains ultraviolet rays in a wavelength region harmful to the human body and components (synthetic resins and metals) of a lighting device. In the conventional art, therefore, the arc tube body 2 is configured in the following manner. As shown in FIG. 29, cylindrical shroud glass 2*b* having a UV cutoff function is welded and integrated with an arc tube 2*a* to form a structure in which a discharging portion $\mathbf{2}a_1$ is enclosed by the shroud glass 2*b*, thereby reducing ultraviolet rays contained in light emitted from the arc tube body.

A conventional discharge lamp device is structured in the following manner. A rearward elongating portion $\mathbf{2}a_2$ of the arc tube which elongates in the rear of the shroud glass 2*b* is inserted into a front opening 1*a* of an insulating plug (insulating base) 1 which is made of a synthetic resin. The rear end side (a rear end portion of the shroud glass 2*b*) of the arc tube body 2 is fixingly supported by a fixing holder 3 which is secured to the front face of the insulating plug 1, and which is made of a metal. The front end side of the arc tube body 2 is supported by a lead support 4 which forward elongates from the insulating plug 1, and which is made of a metal.

The reference numeral 6 denotes a light blocking film for luminous intensity distribution control, which is disposed on an outer side face of the shroud glass 2*b* and is used for blocking part of light advancing toward an effective reflecting surface 8*a* of a reflector 8 to form a definite clear cut line.

In a reflection-type head lamp in which the above-mentioned conventional discharge lamp device is used as a light source, the effective reflecting surface 8*a* of the reflector 8 becomes cloudy.

According to studies by the inventors, it was assumed that such cloud is caused by UV components contained in leakage light from the arc tube body 2. Specifically, as indicated by the arrows in FIG. 29, part of light emitted from the discharging portion $\mathbf{2}a_1$ of the arc tube leaks from the rearward elongating portion $\mathbf{2}a_2$ and the like of the arc tube to irradiate the interior of the front opening 1*a* of the insulating plug 1. This leakage light contains ultraviolet rays in the wavelength region harmful to a synthetic resin. The insulating plug (PPS resin) is exposed to the ultraviolet rays to degrade and generate a sulfuric gas. The sulfuric gas is seemed to tarnish or cloud the effective reflecting surface 8*a* of the reflector 8.

Japanese Patent Laid-Open No. 2001-23427 discloses a conventional technique of solving the problem. In the technique, the area where a light blocking film for luminous intensity distribution control is disposed on shroud glass is extended to a root portion of the rear end side of the shroud glass (outer tube), whereby the amount of UV irradiation applied on the recess of a synthetic resin insulating plug so as to cope with the series of problems such as degradation of the resin due to UV.

In the above-described conventional art, the light blocking film for controlling the luminous intensity distribution which is required to have heat resistance and hence expensive is extended to the root portion of the rear end side of the shroud glass (outer tube). Therefore, a resulting discharge lamp device is further expensive. In order to form the light blocking film for luminous intensity distribution-control, a drying process is performed by baking the shroud glass at a high temperature of, for example, 900° C. Since the light blocking film is applied in a wide range, there arise problems in that the number of drying heaters must be increased, and that the time period required for the drying process is prolonged to increase the production cost.

Usually, the light blocking film for luminous intensity distribution control is colored in black. Since the light blocking film is extended to the root portion of the rear end side of the shroud glass (outer tube), the extended light blocking film is seen in black through a front lens, thereby impairing the appearance. In the field of a lamp, particularly, there is a recent tendency to control the luminous intensity distribution by a reflector and not to dispose steps for luminous intensity distribution control. Therefore, the light blocking film for luminous intensity distribution control is seen in black and in a large size through a front lens in which no step is disposed, whereby the appearance is largely impaired.

The inventors conducted experiments for ascertaining the effectiveness of blocking on the lighting time (the effectiveness such as that defects of, for example, a cloud on the effective reflecting surface 8*a* of the reflector 8 are not produced) while, as shown in FIG. 30, light is blocked in: only a rearward elongating portion A of the arc tube; only a rear end portion B (including the rear end) of the shroud glass facing the interior of the front opening 1*a* of the insulating plug; only a band region C between the fixing holder 3 and the light blocking film 6 for luminous intensity distribution control; only a region D which is below the light blocking film 6, and which corresponds to the vicinity of a bulb insertion hole; and all of the regions A to D. Results shown in FIG. 31 were obtained.

From the results, it was confirmed that, in the case where all of the regions A to D are blocked, the effectiveness is naturally attained, and the effectiveness is attained also in the case where the light blocking film is formed in only the rearward elongating portion A of the arc tube or in only the rear end portion B of the shroud glass facing the interior of the front opening 1*a* of the insulating plug 1. Furthermore, it was confirmed that the case where only A is blocked is more effective than that where only B is blocked. This seems to be caused by a phenomenon that the energy of leakage light from the arc tube is in proportion to the distance from the discharging portion. It was found that, in order to avoid defects such as UV degradation, blocking of leakage light from the rear end portion B of the shroud glass which is closer to the discharging portion than the rearward elongating portion. A is most effective. Namely, it is preferable to block leakage light from the rear end portion of the shroud glass before the light reaches the inner peripheral face of the front opening of the insulating plug.

The structure in the periphery of the front opening 1*a* of the insulating plug 1 will be considered. The metal fixing holder 3 which fixingly supports the shroud glass 2*b* is disposed in the peripheral edge portion of the front opening 1*a* of the insulating plug 1. Therefore, it has been considered that, when, for example, an economical light blocking member made of a metal is fixed to the metal fixing holder 3 so as to block leakage light from the rear end portion of the shroud glass 2*b*, therefore, the structure is simplified, and the production cost is not increased. The invention is based on this finding.

As discussed above, in the case where a UV blocking film is formed in all of the regions A to D, the effectiveness is naturally attained. It was confirmed that the effectiveness is attained also in the case where a UV blocking film is formed in only the rearward elongating portion A of the arc tube or in only the rear end portion B of the shroud glass facing the interior of the front opening 1*a* of the insulating plug 1.

SUMMARY OF THE INVENTION

The invention has been conducted in view of the above-discussed problems of the conventional art and on the basis of the above-mentioned finding of the inventor. It is an object of the invention to provide a discharge lamp device in which emission of UV rays from a limited region of the arc tube body is blocked, so that defects such as UV degradation are not caused in an insulating plug made of a synthetic resin, and which does not adversely affect the appearance of a lighting device.

Further, the invention has been conducted in view of the above-discussed problems of the conventional art and on the basis of the above-mentioned finding of the inventor. It is also an object of the invention to provide a discharge lamp device in which emission of UV rays from a limited region of the arc tube body is blocked by a simple configuration that can be economically produced, so that defects such as UV degradation are not caused in an insulating plug made of a synthetic resin.

In order to attain the object, the discharge lamp device of a first aspect of the invention is a discharge lamp device in which an arc tube body is configured by welding and integrating cylindrical shroud glass with an arc tube to enclose a discharging portion, and a rearward elongating portion of the arc tube that elongates in a rear of the shroud glass is inserted and held into a front opening of an insulating plug which is made of a synthetic resin, wherein a UV blocking film is formed on an outer surface of the rearward elongating portion of the arc tube.

Accordingly, as the UV blocking film, a ZnO film, a $TiO_2$ film, a multilayer vapor-deposited film, an acrylic vapor-deposited film, or the like may be used. When light leaking from the rearward elongating portion of the arc tube is transmitted through the UV blocking film, UV components of the light are cut off, and hence the light has small UV components. The light is then guided into the front opening of the insulating plug made of a synthetic resin.

The rearward elongating portion of the arc tube on which the UV blocking film is formed is inserted and held into the front opening of the insulating plug. Therefore, is the UV blocking film cannot be seen through a front lens.

According to a second object of the invention, the discharge lamp device of the first aspect is configured so that a light blocking member is interposed between a periphery of the front opening of the insulating plug and a rear end portion of the shroud glass, the light blocking member blocking light which is transmitted through the shroud glass and directed toward the front opening of the insulating plug. The device may be configured so that a fixing holder which is fixed to the front face of the insulating plug to fixingly support a rear end portion of the shroud glass, and which is made of a metal serves also as the light blocking member.

As a result, light (containing UV components) which is transmitted through the rear end portion of the shroud glass and directed toward the interior of the front opening of the insulating plug is blocked by the light blocking member that is interposed between the periphery of the front opening of the insulating plug and the rear end portion of the shroud glass, and hence does not reach the interior of the front opening of the insulating plug.

The fixing holder which is fixed to the insulating plug to fixingly support the rear end portion of the shroud glass functions also as a cover (light blocking member) which hides the UV blocking film.

According to the third aspect of the invention, the discharge lamp device of the first aspect is configured so that a cylindrical light blocking member for preventing UV degradation is disposed along an inner peripheral face of the front opening of the insulating plug.

As a result, light (containing UV components) which is transmitted through the rear end portion of the shroud glass and directed toward the interior of the front opening of the insulating plug is blocked by the cylindrical light blocking member for preventing UV degradation that is disposed on the surface layer side of the inner peripheral face of the front opening of the insulating plug, and hence does not reach the resin layer on the rear side of the light blocking member.

According to a fourth aspect of the invention, the discharge lamp device of the first aspect is configured so that a light blocking member is interposed between a periphery of the front opening of the insulating plug and a rear end portion of the shroud glass, the light blocking member blocking light which is transmitted through the shroud glass and directed toward the front opening of the insulating plug, and a cylindrical light blocking member for preventing UV degradation is disposed along an inner peripheral face of the front opening of the insulating plug made of a synthetic resin.

As a result, light (containing UV components) which is transmitted through the rear end portion of the shroud glass and directed toward the interior of the front opening of the insulating plug is blocked by the light blocking member that is interposed between the periphery of the front opening of the insulating plug and the rear end portion of the shroud glass, and hence does not reach the interior of the front opening of the insulating plug. Even when the light (containing UV components) fails to be completely blocked by the light blocking member and leaks into the front opening of the insulating plug, moreover, the light is blocked by the cylindrical light blocking member for preventing UV degradation which is disposed along the inner peripheral face of the opening. Therefore, the light (containing UV components) emitted from the arc tube does not reach the resin layer on the rear side of the light blocking member.

The discharge lamp device according to a fifth aspect of the invention is a discharge lamp device in which an arc tube body is configured by welding and integrating cylindrical shroud glass with an arc tube to enclose a discharging portion, and a rearward elongating portion of the arc tube which elongates in a rear of the shroud glass is inserted and held into a front opening of an insulating plug which is made of a synthetic resin, wherein the rearward elongating portion of the arc tube and/or a rear end portion of the shroud glass facing an interior of the front opening of the insulating plug is covered by a cylindrical light shade which has a UV cutoff function, and which is made of a nonmetallic material.

Accordingly, in the configuration in which the rearward elongating portion of the arc tube is covered by the light shade, light containing UV components does not leak from the rearward elongating portion of the arc tube into the opening. Furthermore, in the configuration in which the rear end portion of the shroud glass is covered by the light shade, light containing UV components does not leak from the rear end portion of the shroud glass into the opening. Moreover, in the configuration in which the rearward elongating portion of the arc tube and the rear end portion of the shroud glass are covered by the light shade, light containing UV components does not leak from the rearward elongating portion of the arc tube and the rear end portion of the shroud glass into the opening.

Preferably, the cylindrical light shade is made of an inorganic material having a UV cutoff function and excellent heat resistance, such as a ceramic sleeve or soft glass. Such a light shade can be easily formed by sintering or molding, and hence can be easily attached so as to cover the arc tube body.

Even when the cylindrical light shade made of a nonmetallic material is used in the insulating plug that generates a high voltage, there is no possibility of dielectric breakdown, so that the safety is ensured. Specifically, a lead wire which is a current path is drawn out from the rearward elongating portion of the arc tube. If the cylindrical light shade covering the rearward elongating portion is made of a metal, dielectric breakdown such as a discharge between the lead wire and the cylindrical light shade may occur. In the case of the cylindrical light shade made of a nonmetallic material, there is no fear of dielectric breakdown.

Since the rearward elongating portion of the arc tube or the rear end portion of the shroud glass which is covered by the cylindrical light shade is inserted and held into the front opening of the insulating plug, the light shade cannot be seen through a front lens.

The discharge lamp device according to a sixth aspect of the invention is a discharge lamp device in which an arc tube body is configured by welding and integrating cylindrical shroud glass with an arc tube to enclose a discharging portion, and a rearward elongating portion of the arc tube which elongates in a rear of the shroud glass is inserted and held into a front opening of an insulating plug which is made of a synthetic resin, wherein a light blocking film for luminous intensity distribution control is disposed on an outer surface of the shroud glass, and a UV blocking film which is different in composition from the light blocking film is disposed on the rearward elongating portion of the arc tube and/or a rear end portion of the shroud glass facing an interior of the front opening of the insulating plug.

Accordingly, when light leaking from the rearward elongating portion of the arc tube or the rear end portion of the shroud glass facing the interior of the front opening of the insulating plug is transmitted through the UV blocking film, UV components of the light are cut off, and hence the light has small UV components. The light is then guided into the front opening of the insulating plug made of a synthetic resin.

In order to form a definite clear cut line, the light blocking film for luminous intensity distribution control is requested to have properties of blocking visible light components. Since disposed in the vicinity of the discharging portion of the arc tube to be exposed to a high temperature, the light blocking film is further requested to have heat resistance. By contrast, the UV blocking film is requested to have properties of blocking UV components, but is not requested to have heat resistance which is so high as that requested in the light blocking film for luminous intensity distribution control, because the UV blocking film is disposed in the rearward elongating portion or the rear end portion of the shroud glass which is separated from the discharging portion of the arc tube. Therefore, a UV blocking film having composition which is different from that of the light blocking film for luminous intensity distribution control, and which is optimum for properties of blocking UV components is used, thereby effectively cutting off UV components of light leaking from the rearward elongating portion of the arc tube or the rear end portion of the shroud glass.

Since the rearward elongating portion of the arc tube or the rear end portion of the shroud glass on which the UV blocking film is formed is inserted and held into the front opening of the insulating plug, the UV blocking film cannot be seen through a front lens.

In order to attain the object, the discharge lamp device according to a seventh aspect is a discharge lamp device in which an arc tube body is configured by welding and integrating cylindrical shroud glass with an arc tube to enclose a discharging portion, and a rearward elongating portion of the arc tube that elongates in a rear of the shroud glass is inserted and held into a front opening of an insulating plug which is made of a synthetic resin, wherein a light blocking member which is made of a metal is interposed between a rear end portion of the shroud glass and the front opening of the insulating plug, the light blocking member blocking light which is emitted from the rear end portion of the shroud glass, and which reaches an inner peripheral face of the front opening of the insulating plug.

Accordingly, leakage light (containing UV components) which is emitted from the rear end portion of the shroud glass and directed toward the interior of the front opening of the insulating plug is blocked by the metal light blocking member that is interposed between the rear end portion of the shroud glass and the front opening of the insulating plug, and hence does not reach the interior of the front opening of the insulating plug. As a result, the interior of the front opening of the insulating plug is not exposed to ultraviolet rays. Although leakage light (containing UV components) which is emitted from the rearward elongating portion of the arc tube irradiates the interior of the front opening of the insulating plug, the energy of the light is smaller than that of the leakage light from the rear end portion of the shroud glass, and hence influences such as UV degradation of the insulating plug is negligible.

The metal light blocking member can be formed into an arbitrary shape by, for example, press molding of a sheet metal. Therefore, the metal light blocking member can be easily processed into a predetermined shape which is appropriate for blocking leakage light from the rear end portion of the shroud glass, and which can be housed and fixed between the rear end portion of the shroud glass and the front opening of the insulating plug.

According to an eighth aspect of the invention, the discharge lamp device of the seventh aspect is configured so that a supporting member which is made of a metal, and which fixingly supports a portion in a vicinity of the rear end portion of the shroud glass is disposed on a front face of the insulating plug made of a synthetic resin, and the metal light blocking member is fixed and integrated with the metal supporting member, or formed integrally with the metal supporting member.

As a result, since the metal light blocking member is supported by the metal supporting member which is required for fixingly supporting a portion in the vicinity of the rear end portion of the shroud glass, it is not necessary to additionally dispose fixing means for supporting the metal light blocking member.

According to a ninth aspect of the invention, the discharge lamp device of the eighth aspect is configured so that the metal supporting member includes a gripping band which is made of a metal, and which grips a portion in a vicinity of the rear end portion of the shroud glass, and the metal light blocking member has a shape of a bottomed cylinder which is coveringly attached to the rear end portion of the shroud glass, and is fixed and integrated with the metal gripping band, or formed integrally with the gripping band.

As a result, leakage light (containing UV components) which is emitted from the rear end portion of the shroud glass and directed toward the interior of the is front opening of the insulating plug is blocked by the metal light blocking member which is coveringly attached to the rear end portion of the shroud glass, and hence does not reach the interior of the front opening of the insulating plug.

The metal light blocking member is fixed to the metal gripping band, or formed integrally with the metal gripping band. Therefore, the metal light blocking member can be held in a state where the member is coveringly attached to the rear end portion of the shroud glass, by fixing the metal gripping band to the shroud glass.

According to a tenth aspect of the invention, the discharge lamp device of the eight aspect is configured so that the metal supporting member includes: a gripping band which is made of a metal, and which grips a portion in a vicinity of the rear end portion of the shroud glass; and a slide plate which is made of a metal, and which is used for positioning the arc tube body, the metal slide plate fixing the gripping band to a front face of the insulating plug, and the metal light blocking member has a shape of a bottomed cylinder which is loosely fitted on the rear end portion of the shroud glass, and is integrated with the metal slide plate.

As a result, leakage light (containing UV components) which is emitted from the rear end portion of the shroud glass and directed toward the interior of the front opening of the insulating plug is blocked by the light blocking member which is loosely fitted on the rear end portion of the shroud glass, and hence does not reach the interior of the front opening of the insulating plug.

The metal light blocking member is previously integrated with the metal slide plate. At the same time when the metal slide plate is fixed to the insulating plug, therefore, the metal light blocking member can be held in a state where the member is loosely fitted on the rear end portion of the shroud glass.

According to an eleventh aspect of the invention, the discharge lamp device of the eight aspect is configured so that the metal supporting member includes: a gripping band which is made of a metal, and which grips a portion in a vicinity of the rear end portion of the shroud glass; a base plate which is made of a metal, and which is fixed to a front face of the insulating plug; and a slide plate which is made of a metal, and which is used for positioning the arc tube body, the metal slide plate fixing the gripping band to the base plate, and the metal light blocking member has a shape of a bottomed cylinder which is loosely fitted on the rear end portion of the shroud glass, and is clamped between the metal base plate and the metal slide plate.

As a result, leakage light (containing UV components) which is emitted from the rear end portion of the shroud glass and directed toward the interior of the front opening of the insulating plug is blocked by the light blocking member which is loosely fitted on the rear end portion of the shroud glass, and hence does not reach the interior of the front opening of the insulating plug.

When the metal base plate is fixed with the metal slide plate, the metal light blocking member can be clamped and fixed by both the plates.

According to a twelfth aspect of the invention, the discharge lamp device of the seventh aspect is configured so that the metal light blocking member has a shape of a cylinder which extends along an inner peripheral face of the front opening of the insulating plug, the inner peripheral face facing the rear end portion of the shroud glass, and is pressingly inserted into the front opening of the insulating plug, and retained by a supporting member which is made of a metal, and which is disposed on a front face of the insulating plug made of a synthetic resin to fixingly support a portion in a vicinity of the rear end portion of the shroud glass.

As a result, leakage light (containing UV components) which is emitted from the rear end portion of the shroud glass and directed toward the interior of the front opening of the insulating plug is blocked by the metal light blocking member which extends along the inner peripheral face of the front opening of the insulating plug, and hence does not reach the resin layer on the rear side of the light blocking member.

Moreover, the metal supporting member which is required for fixingly supporting a portion in the vicinity of the rear end portion of the shroud glass retainingly holds the metal light blocking member.

According to a thirteenth aspect of the invention, the discharge lamp device of the seventh aspect is configured so that the metal light blocking member has a shape of a bottomed cylinder which is coveringly attached to the rear end portion of the shroud glass, and is retainingly held by engaging an elastic engaging piece which is formed in a peripheral edge portion of an insertion hole for the rearward elongating portion of the arc tube on a side of the metal light blocking member, with a constricted portion which is disposed in a root portion of the rearward elongating portion of the arc tube.

As a result, leakage light (containing UV components) which is emitted from the rear end portion of the shroud glass and directed toward the interior of the front opening of the insulating plug is blocked by the metal light blocking member which is coveringly attached to the rear end portion of the shroud glass, and hence does not reach the interior of the front opening of the insulating plug.

When the rearward elongating portion of the arc is tube is passed through the insertion hole for the rearward elongating portion of the arc tube on the side of the metal light blocking member, the elastic engaging piece in the peripheral edge portion of the hole is elastically engaged with the constricted portion of the root portion of the rearward elongating portion of the arc tube, whereby the metal light blocking member which is coveringly attached to the rear end portion of the shroud glass is retainingly held.

BRIEF DESCRIPTION OF THE DRAWINGS

FIG. 7(*b*) is a section view of main portions of is another modification of the second embodiment.

FIG. 15(*b*) is a longitudinal section view of the rear end side of the arc tube body.

FIG. 17(*b*) is a longitudinal section view of the rear end side of the arc tube body.

FIG. 19(*b*) is a longitudinal section view of the rear end side of the arc tube body.

FIG. 31 is a view showing experimental results.

DETAILED DESCRIPTION OF THE PREFERRED EMBODIMENTS

Next, modes for carrying out the invention will be described on the basis of embodiments.

Figure 1:
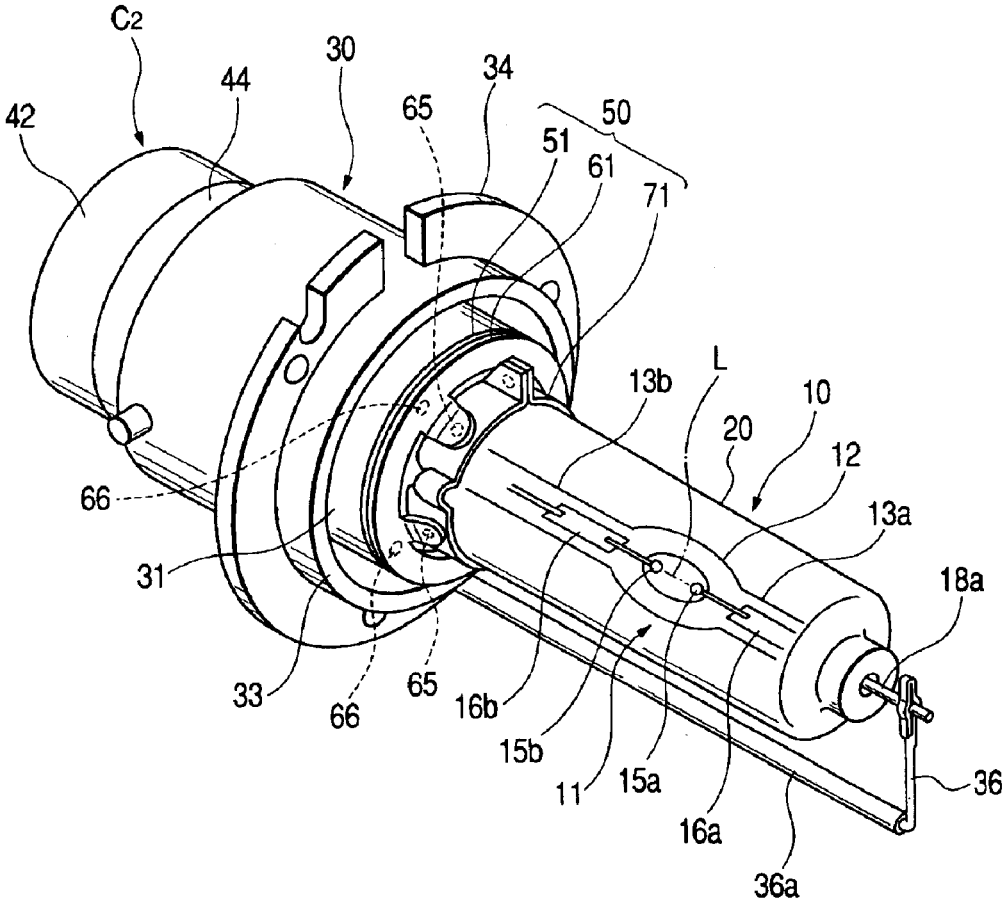
FIG. 1 is a perspective view of a discharge lamp device which is a first embodiment of the invention.
Figure 2:
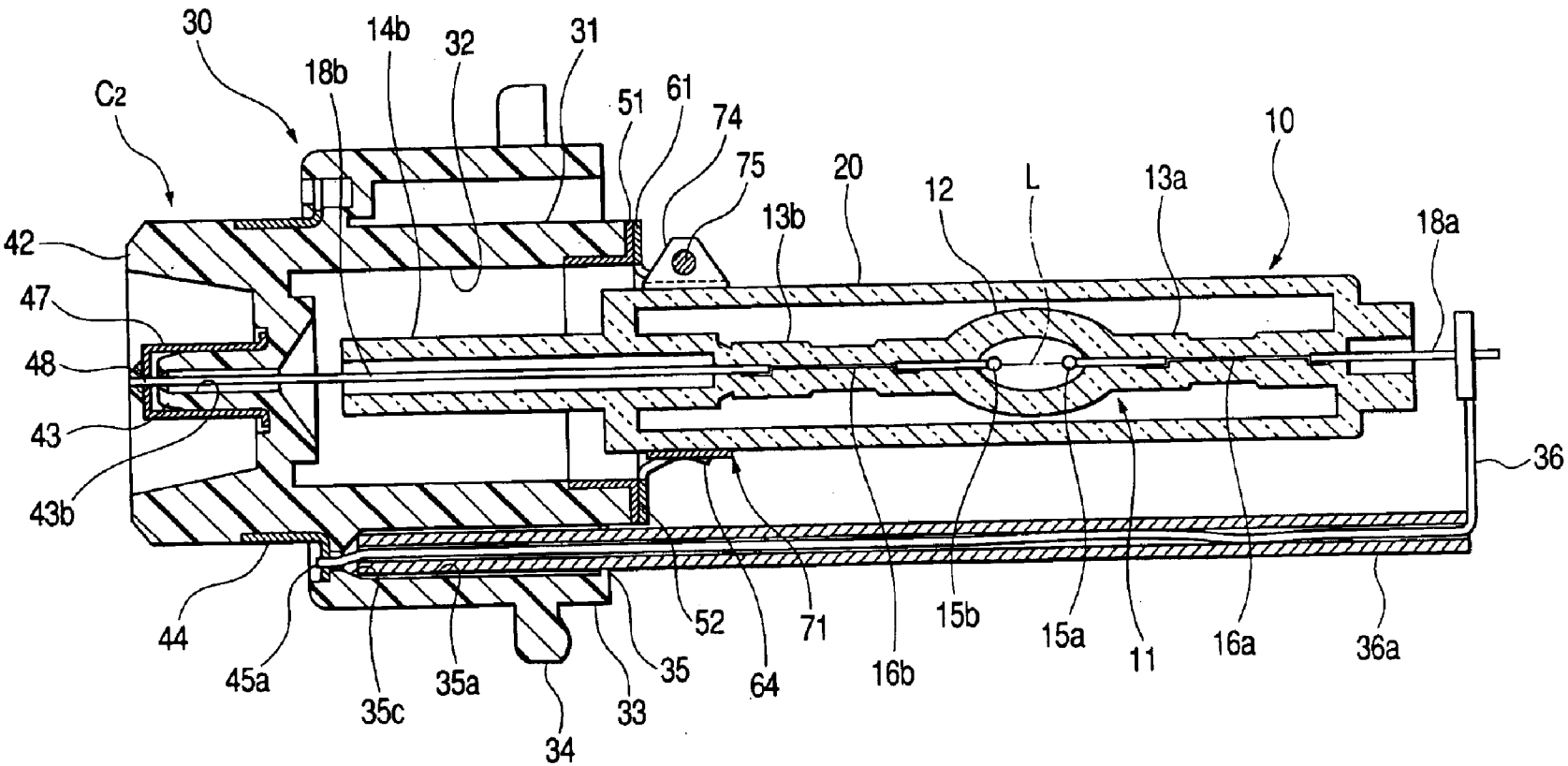
FIG. 2 is a longitudinal section view of the discharge lamp device.
Figure 3:
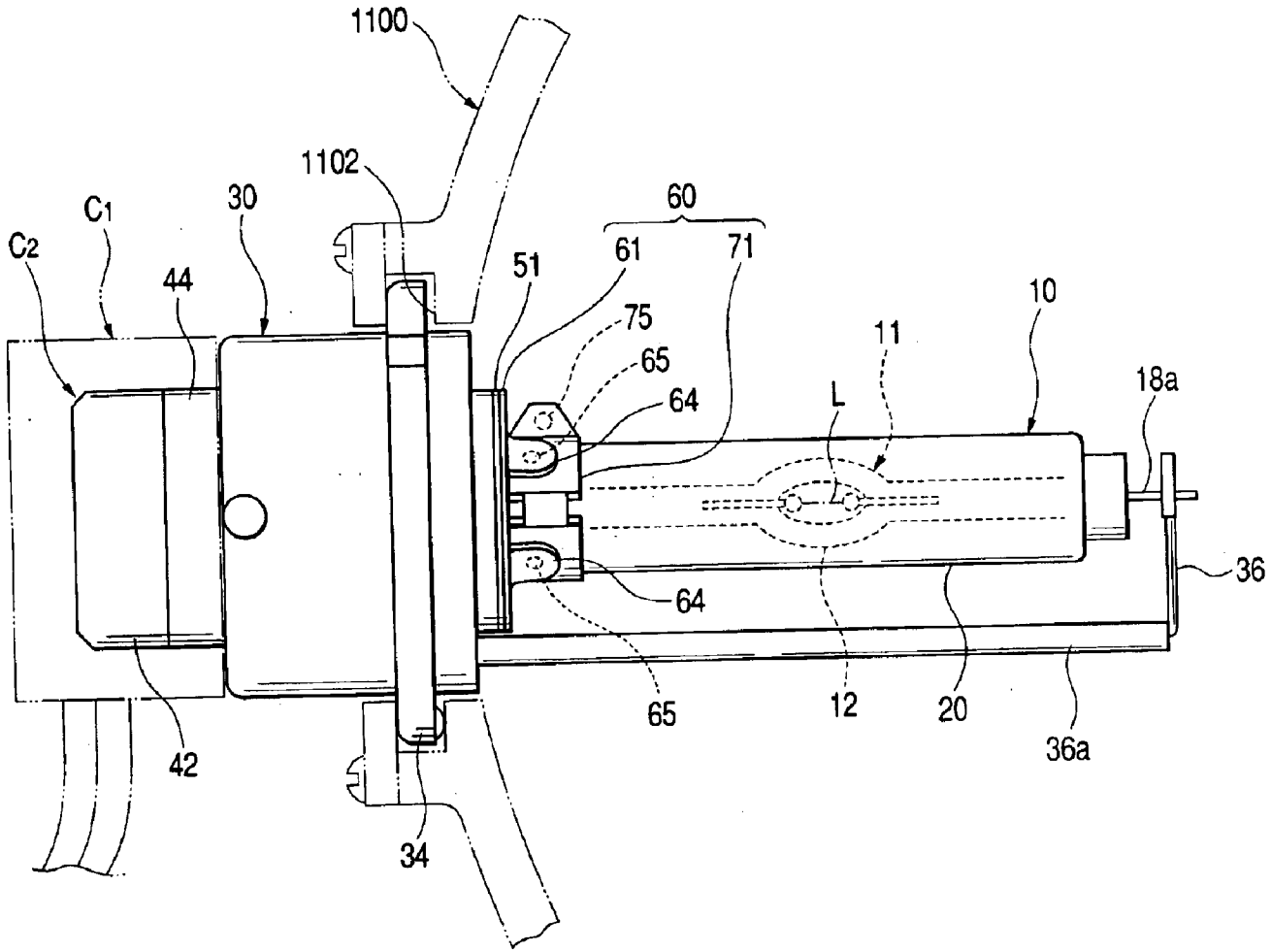
FIG. 3 is a side view of the discharge lamp device.
Figure 4:
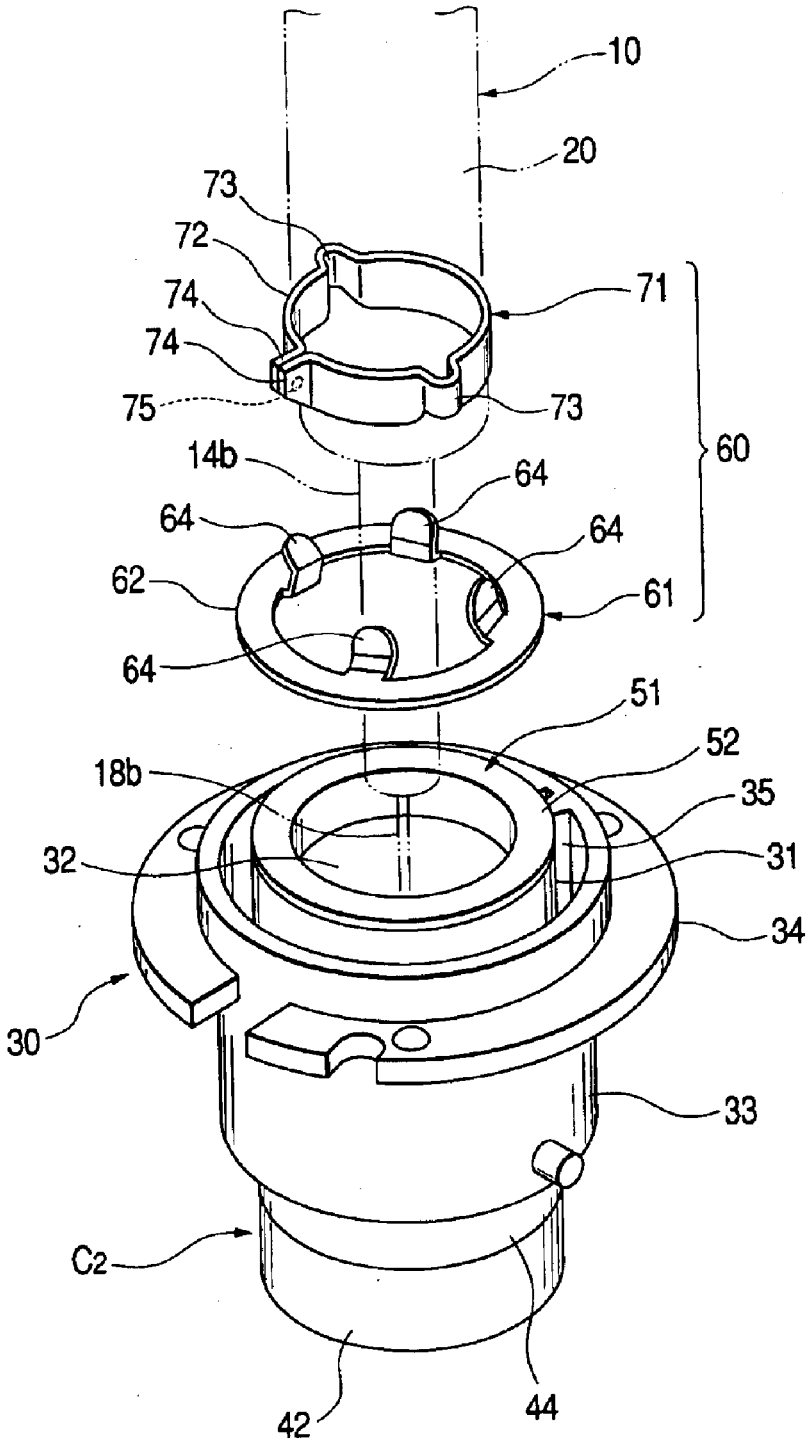
FIG. 4 is an exploded perspective view of a supporting member which fixingly supports a rear end portion of shroud glass.
Figure 5:
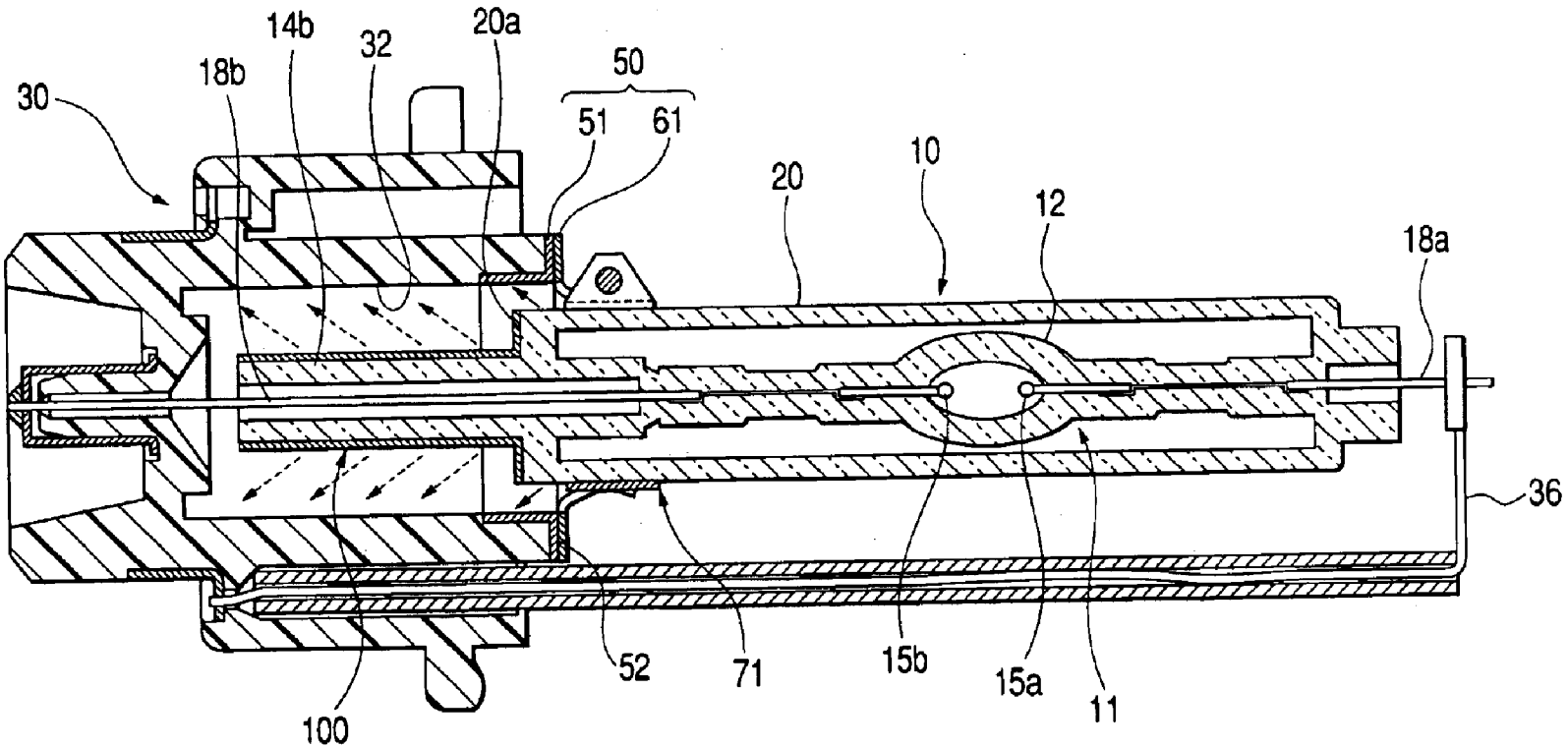
FIG. 5 is a section view showing a UV blocking film forming region in the arc tube body.

FIGS. 1 to 5 show a first embodiment of the invention. FIG. 1 is a perspective view of a discharge lamp device which is the first embodiment of the invention, FIG. 2 is a longitudinal section view of the discharge lamp device, FIG. 3 is a side view of the discharge lamp device, FIG. 4 is an exploded perspective view of a supporting member which fixingly supports a rear end portion of shroud glass, and FIG. 5 is a section view showing a UV blocking film forming region (UV blocking portion) in the arc tube body.

In the figures, the reference numeral 30 denotes an insulating plug which is made of PPS resin. A lamp-side connector $C_2$ into which a power supply connector $C_1$ (see FIG. 3) can be inserted is disposed integrally in a rear end portion of the insulating plug. A focusing ring 34 which is engaged with a bulb insertion hole 1102 (see FIG. 3) of a reflector 1100 of an automotive head lamp is disposed on the outer periphery of the insulating plug. The arc tube body 10 is fixingly supported in front of the insulating plug 30 by a metal lead support 36 which forward elongates from the plug 30, and a metal supporting member 50 which is fixed to the front face of the plug 30, thereby constituting the discharge lamp device.

Specifically, the discharge lamp device is structured in the following manner. A lead wire 18*a* which is drawn out from a front end portion of the arc tube body 10 is fixed by spot welding to a bent front end portion of the lead support 36 elongating from the insulating plug 30. A rear end portion of the arc tube body 10 is gripped by the metal supporting member 50 configured by a base plate 51 which is fixed to the front face of the insulating plug 30, a slide plate 61, and an arc tube gripping band 71.

The arc tube body 10 has a structure in which cylindrical ultraviolet-ray blocking shroud glass 20 is integrally welded (sealingly attached) to an arc tube 11 having a closed glass globe 12 wherein electrodes 15*a* and 15*b* are paired to be opposed to each other, so that the shroud glass 20 encloses and hermetically seals the closed glass bulb 12. The reference character L denotes a discharge axis connecting the electrodes 15*a* and 15*b*.

The arc tube 11 is produced from a quartz glass tube having a circular pipe-like shape, and is structured so that the closed glass globe 12 having a shape of an ellipsoid of revolution is formed at a predetermined position in the longitudinal direction to be interposed between pinch seal portions 13*a* and 13*b* having a rectangular cross section shape. The glass globe 12 is filled with a rare gas for starting, mercury, and a metal halide (for example, a sodium-scandium light emitting substance). Rectangular molybdenum foils 16*a* and 16*b* are sealed in the pinch seal portions 13*a* and 13*b*, respectively. In the molybdenum foils 16*a* and 16*b*, the electrodes 15*a* and 15*b* which are opposed to each other in the closed glass globe 12 are connected to one side, and lead wires 18*a* and 18*b* which are drawn to the outside of the arc tube 11 are connected to the other side. The region of the arc tube 11 extending from the pinch seal portions 13*a* and 13*b* to the closed glass globe 12 is enclosed and hermetically sealed by the shroud glass 20. A rearward elongating portion 14*b* (see FIG. 2) which is a non-pinch seal portion of the arc tube 11, and which has a circular pipe-like shape elongates in the rear of the shroud glass 20.

The shroud glass 20 is configured by quartz glass into which $TiO_2$ and $CeO_2$ are doped, and which has a function of blocking ultraviolet rays, so that ultraviolet rays in a wavelength region harmful to the human body are surely cut off from light emitted from the closed glass globe 12 serving as a discharging portion. The interior of the shroud glass 20 is set to a vacuum state or a inert gas-filled state, and designed so as to exert a heat insulating function with respect to radiation of heat from the closed glass globe 12 serving as a discharging portion, thereby preventing the lamp characteristics from being affected by a change of the external environment.

A cylindrical inner tube portion 31 having an opening 32 in which the rearward elongating portion 14*b* of the arc tube 11 can be inserted and housed is formed in the front face side of the insulating plug 30. A cylindrical outer tube portion 33 around which the focusing ring 34 is disposed is formed around the inner tube portion 31 except a bridge portion 35 in which a lead support insertion hole 35*a* is formed. An insulating sleeve 36*a* which is made of ceramics, and through which the lead support 36 is passed is inserted into the lead support insertion hole 35*a*. A rear end portion of the lead support 36 which is passed through the insulating sleeve 36*a* rearward is projected from a tapered hole 35*c* (see FIG. 2) which is opened in the back face of the insulating plug 30, passed through a lead support engaging hole 45*a* of a belt-type terminal 44 which is disposed in a rear end portion of the insulating plug 30, and then laser-welded thereto.

The cylindrical base plate 51 made of a metal is closely fixed to the front edge of the inner tube portion 31. The base plate 51 is integrated with the insulating plug 30 in the form in which a disk-like basal portion 52 (see FIG. 4) is exposed, by insert molding in which injection molding is conducted in a state where the base plate 51 is inserted into a mold.

A vertically holding member 60 which is made of a metal, and which is configured by the slide plate 61 made of a metal and the arc tube gripping band 71 made of a metal to vertically hold the shroud glass 20 of the arc tube body 10 is joined and fixed to the disk-like basal portion 52 of the base plate 51 integrated with the insulating plug 30, and placed so that the discharge axis L of the arc tube body 10 coincides with the center axis of the focusing ring 34.

Specifically, in the arc tube gripping band 71 constituting the vertically holding member 60, as shown in FIG. 4, rectangular tag pieces 74 which are bent into an L-like section shape are formed in butting end portions of the belt-like band body 72, respectively. The tag pieces 74 of the band body 72 which is wound around the shroud glass 20 of the arc tube body 10 are butt each other, and then spot-welded together, whereby the gripping band 71 can be wound and fixed to the shroud glass 20. The reference numeral 73 denotes bent portions which are disposed in two longitudinally separated places of the band body 72, respectively. When the bent portions 73 are elastically deformed, the band body 72 expands or contracts. This allows the band body 72 to be wound and fixed to the shroud glass 20. The reference numeral 75 denotes a spot-welded portion.

In the metal slide plate 61 constituting the vertically holding member 60, as shown in FIG. 4, the basal portion 62 is formed into a doughnut-like disk shape which matches the basal portion 52 of the base plate 51, and four plate spring-like clamping tongue pieces 64 which are cut and raised are disposed on the inner peripheral edge of the basal portion 62 at regular intervals in the circumferential direction. The outer periphery of the arc tube gripping band 71 which is wound and fixed to the shroud glass 20 of the arc tube body 10 is clamped by the clamping tongue pieces 64, and the clamping tongue pieces 64 are laser-welded to the gripping band 71, whereby the arc tube body 10 is integrated with the slide plate 61 so that the discharge axis L of the arc tube body 10 is perpendicular to the joining face of the slide plate 61 (the lower face of the doughnut-like disk basal portion 62 of the slide plate 61) with respect to the base plate 51, and the gripping band 71 is in a position which is separated from the lower face of the basal portion 62 by a predetermined distance. The reference numerals 65 and 66 denote laser-welded portions.

A cylindrical outer tube portion 42 which rearward elongates, and a columnar boss 43 which rearward elongates in the outer tube portion 42 are formed on the rear end portion of the insulating plug 30. The belt-type terminal 44 having a cylindrical shape and constituting a minus terminal of the lamp-side connector $C_2$ is fixed and integrated with the outer periphery of a root portion of the outer tube portion 42. A cap type terminal 47 constituting a plus terminal of the lamp-side connector is coveringly attached to the boss 43 to be integrated therewith. The reference numeral 48 denotes a lead wire engaging hole which is disposed in a top portion of the cap type terminal 47. The lead wire 18*b* which is drawn out from the rear end side of the arc tube body 10, and which is passed through the opening 32 of the insulating plug 30 and a lead wire insertion hole 43*b* is engaged with the engaging hole 48 and laser-welded thereto.

As shown in FIG. 5, a UV blocking film 100 is formed on the outer surface of the rearward elongating portion 14*b* of the arc tube which elongates in the rear of the shroud glass 20, and a rear end face 20*a* of the shroud glass. In this configuration, UV components of leakage light (see the arrows of broken lines in FIG. 5) from the rearward elongating portion 14*b* and the rear end face 20*a* of the shroud glass are cut off, so that UV degradation and the like do not occur in the resin layer of the inner peripheral face of the opening 32 of the insulating plug. Specifically, when leakage light from the rearward elongating portion 14*b* of the arc tube and the rear end face 20*a* of the shroud glass is transmitted through the UV blocking film 100, UV components are cut off, and hence the light has small UV components. The light then irradiates the interior of the opening 32. Therefore, the amount of ultraviolet rays to which the inner peripheral face (resin layer) of the opening 32 is exposed is reduced, and UV degradation and the like of the resin layer are suppressed.

Also leakage light (the arrows of solid lines in FIG. 5) from the outer periphery of the rear end portion of the shroud glass 20 is guided into the opening 32. However, the base plate 51 which is made of a metal, and which is disposed in the inlet peripheral edge portion of the opening 32 functions as a cylindrical light blocking member for preventing UV degradation, and hence UV degradation and the like of the resin layer in the vicinity of the inlet of the opening 32 are not caused by leakage light from the outer periphery of the rear end portion of the shroud glass 20.

Furthermore, light which is transmitted through the rear end side of the shroud glass 20 and directed toward the opening 32 is blocked from entering the opening 32 by the metal gripping band 71 and the metal slide plate 61 which function as the light blocking member. Therefore, UV degradation of the resin layer in the opening 32 is not caused by light entering from the opening 32.

In the above-described embodiment, the UV blocking film 100 is formed so as to extend from the rearward elongating portion 14*b* of the arc tube to the rear end face 20*a* of the shroud glass. Alternatively, the UV blocking film 100 may be formed also on the outer peripheral face of the rear end portion of the shroud glass 20 facing the interior of the opening 32. In the alternative, also UV components of light leaking from the outer periphery of the rear end portion of the shroud glass 20 are cut off. As a is result, defects such as UV degradation of the resin layer in the opening 32 are further improved.

Figure 6:
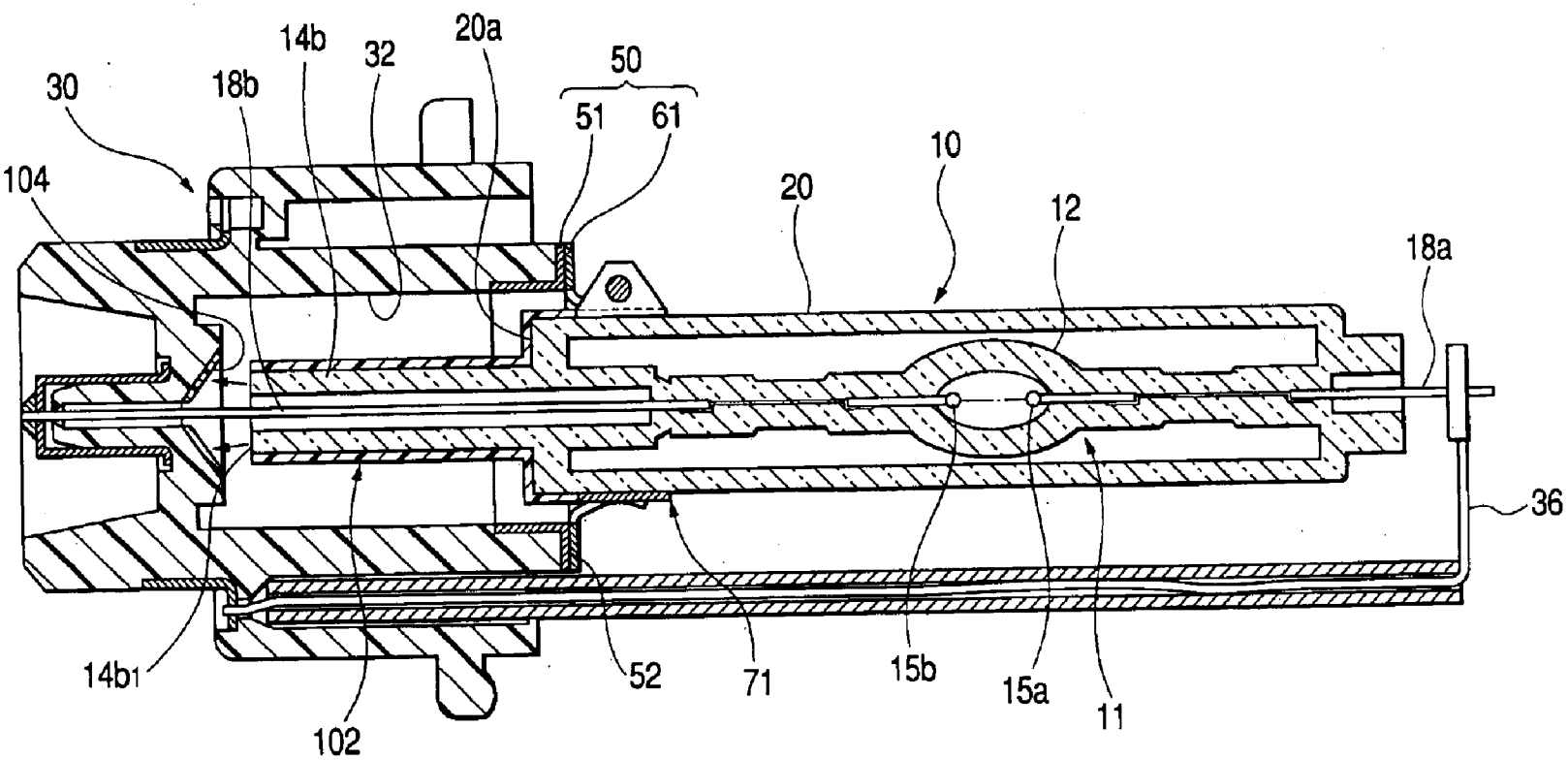
FIG. 6 is a section view of a discharge lamp device which is a second embodiment of the invention.

FIG. 6 is a section view showing a discharge lamp device of a second embodiment of the invention.

In the second embodiment, a region extending from the rearward elongating portion 14*b* of the arc tube to the rear end portion of the shroud glass facing the interior of the opening 32 is covered by a cylindrical light shade 102 (UV blocking portion) which has a UV cutoff function, and which is made of a nonmetallic material, thereby forming a structure in which light containing UV components does not leak, from the rearward elongating portion 14*b* of the arc tube and the rear end portion of the shroud glass 20 into the opening 32.

Namely, light containing UV components and leaking from the rearward elongating portion 14*b* of the arc tube and the rear end portion of the shroud glass 20 is blocked, and the amount of ultraviolet rays to which the opening 32 of the insulating plug is exposed is reduced, so that defects such as degradation of the insulating plug 30 do not occur.

A conical light shade 104 for preventing UV degradation and made of a nonmetallic material is disposed on the bottom face of the opening 32, thereby taking a countermeasure for protecting the resin layer from light containing UV components and leaking from the front end face 14*b*1 of the rearward elongating portion 14*b* of the arc tube.

Preferably, the light shades 102 and 104 are configured by an inorganic or organic material having a UV cutoff function and excellent heat resistance, such as ceramics, glass (UV absorbing glass, soft glass, or opaque glass), a PC resin, or an acrylic resin.

The other components are configured in the same manner as those of the embodiment described above, and denoted by the same reference numerals. Therefore, their duplicated description will be omitted.

The light shades 102 and 104 are made of a nonmetallic material. Even when the light shades are used in the insulating plug 30 that generates a high voltage, there is no possibility of dielectric breakdown, so that the safety is ensured. Specifically, the lead wire 18*b* which is a current path is drawn out from the rearward elongating portion 14*b* of the arc tube, and the lead wire 18*b* is passed through a center hole of the light shade 104. If the light shades 102 and 104 are made of a metal, dielectric breakdown such as a discharge between the lead wire 18*b* and the light shades 102 and 104 may occur. By contrast, in the case of the light shades made of a nonmetallic material, there is no fear of dielectric breakdown.

Since the light shades 102 and 104 are in the opening 32, and hidden by the slide plate 61, the light shades are never seen through a front lens, so that the appearance of a lighting device is not impaired.

Figure 7A:
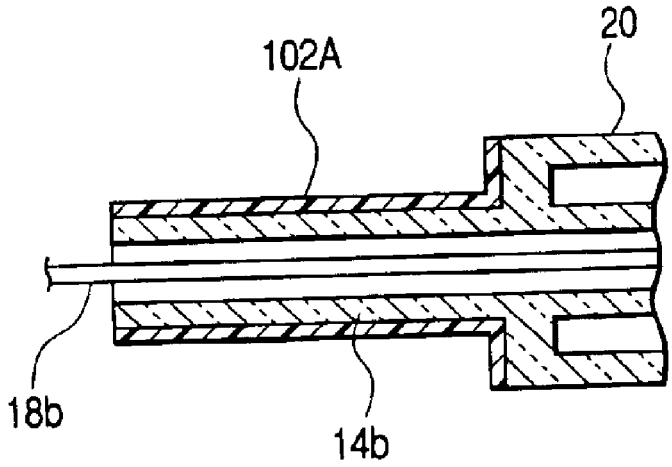
FIG. 7(*a*) is a section view of main portions of a modification of the second embodiment.
Figure 7B:
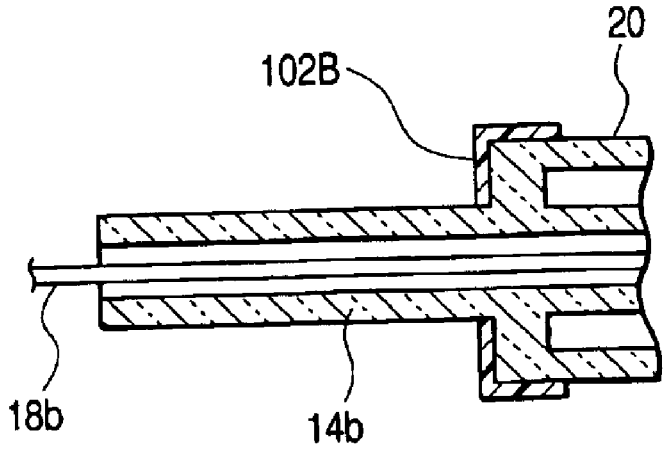

The cylindrical light shade 102 is configured so as to cover the region extending from the rearward elongating portion 14*b* of the arc tube to the rear end portion of the shroud glass 20. Alternatively, as indicated by the reference numerals 102A and 102B in FIGS. 7(*a*) and 7(*b*), the light shade may have a structure in which the light shade covers only the rearward elongating portion 14*b* of the arc tube, or only the rear end portion of the shroud glass 20.

Figure 8:
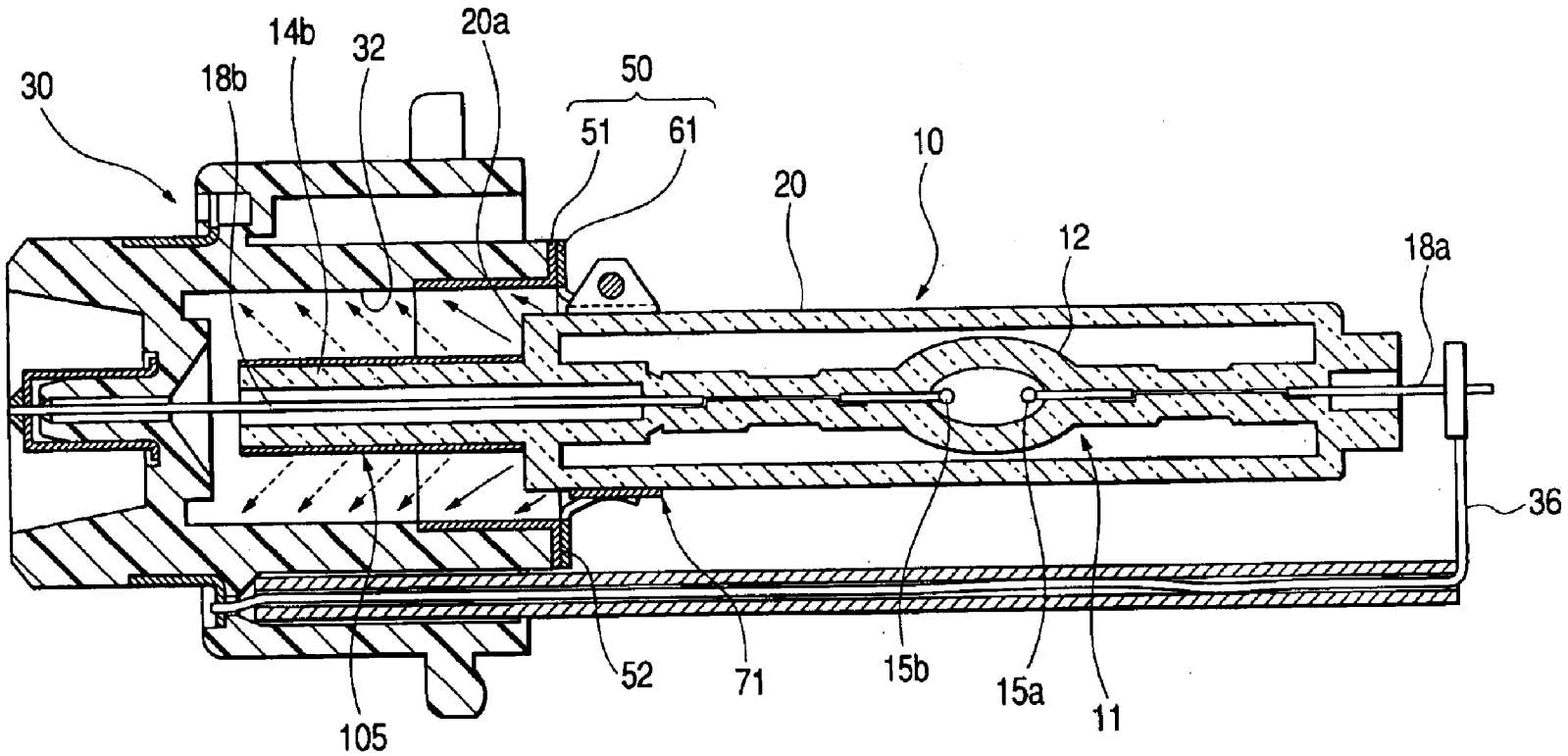
FIG. 8 is a longitudinal section view of a discharge lamp device which is a third embodiment of the invention.

FIG. 8 is a section view showing a discharge lamp device of a third embodiment of the invention.

In the embodiment, an embossing or frosting surface treatment is applied to the surface region, indicated by the reference numeral 105, of the rearward elongating portion 14*b* of the arc tube. Therefore, leakage light (see the arrows of broken lines in FIG. 8) containing UV components and emitted from the rearward elongating portion 14*b* is diffused, so that UV components irradiating the resin layer of the inner peripheral face of the opening 32 are weakened in energy. Consequently, UV degradation gives an effect reduced by a degree corresponding to the weakened energy.

With respect to leakage light (see the arrows of is solid lines in FIG. 8) containing UV components and emitted from (the lower face and the outer peripheral face of) the rear end portion of the shroud glass, a countermeasure is taken by downward lengthening the metal base plate 51 functioning as a UV degradation preventing member.

The other components are configured in the same manner as those of the embodiment described above, and denoted by the same reference numerals. Therefore, their duplicated description will be omitted. In order to prevent UV degradation of the resin layer in the opening 32 from occurring, it is preferable to lengthen the base plate 51 to the vicinity of the bottom face of the opening 32. However, this is limited because the creepage distance between the base plate and the lead wire 18*b* exposed in the opening 32 becomes short to cause the possibility of dielectric breakdown.

Figure 9:
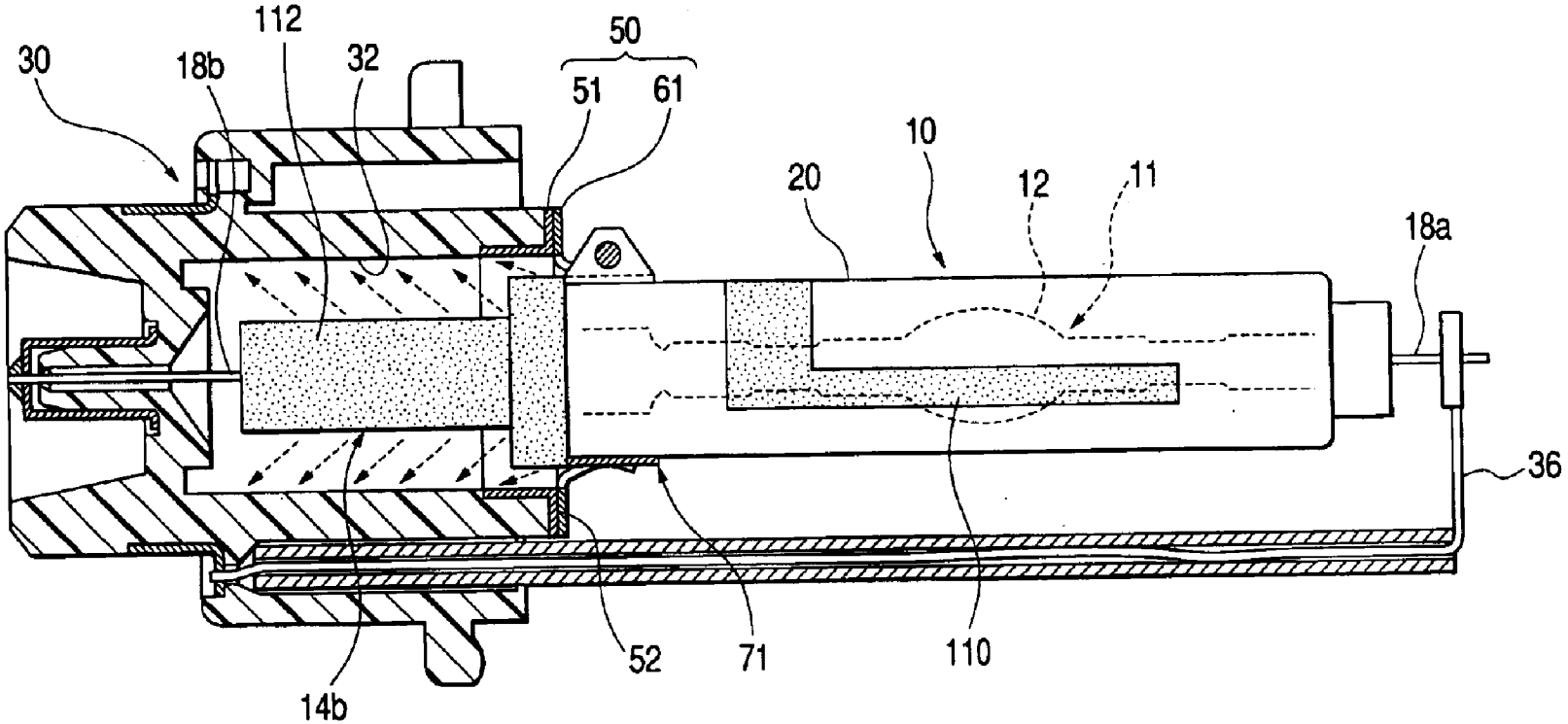
FIG. 9 is a longitudinal section view of a discharge lamp device which is a fourth embodiment of the invention.

FIG. 9 is a section view showing a discharge lamp device of a fourth embodiment of the invention.

A light blocking film 110 for luminous intensity distribution control is formed for forming a clear cut line on the outer surface of the shroud glass 20. A UV blocking film 112 which is different in composition from the light blocking film 110 is formed in the region extending from the rear end portion of the shroud glass 20 facing the interior of the opening 32 to the rearward elongating portion 14*b* of the arc tube.

The light blocking film 110 is disposed in the vicinity of the discharging portion 12 of the arc tube to be exposed to a high temperature, and hence requested to have heat resistance. By contrast, the UV blocking film 112 is requested to have properties of blocking UV components, but is not requested to have heat resistance which is so high as that requested in the light blocking film 110, because the UV blocking film is disposed in the rearward elongating portion 14*b* or the rear end portion of the shroud glass which is separated from the discharging portion 12 of the arc tube. As the UV blocking film 112, therefore, used is a UV blocking film which is different in composition from the light blocking film 110, in which heat resistance is lowered, and which is optimum for properties of blocking UV components, thereby effectively cutting off UV components of light leaking from the rearward elongating portion 14*b* of the arc tube or the rear end portion of the shroud glass 20.

The rearward elongating portion 14*b* of the arc tube and the rear end portion of the shroud glass on which the UV blocking film 112 is formed are inserted and held into the opening 32 of the insulating plug. When the discharge lamp device of the embodiment is used as a light source for a head lamp (a light source for forming a dipped beam), therefore, the UV blocking film 112 cannot be seen through a front lens, and the appearance is never impaired.

In the fourth embodiment described above, the UV blocking film 112 is formed on both the rearward elongating portion 14*b* of the arc tube and the rear end portion of the shroud glass facing the interior of the opening 32. Alternatively, the film may be formed on only one of the rearward elongating portion 14*b* of the arc tube and the rear end portion of the shroud glass. Although the effect is slightly lower than that in the case where the film is formed on both the portions, the alternative is certainly effective in prevention of UV degradation of the resin layer in the opening 32, and the like, as shown in experimental results of FIG. 12.

Next, other embodiments of the invention will be described with reference to FIGS. 10 to 28.

Figure 10:
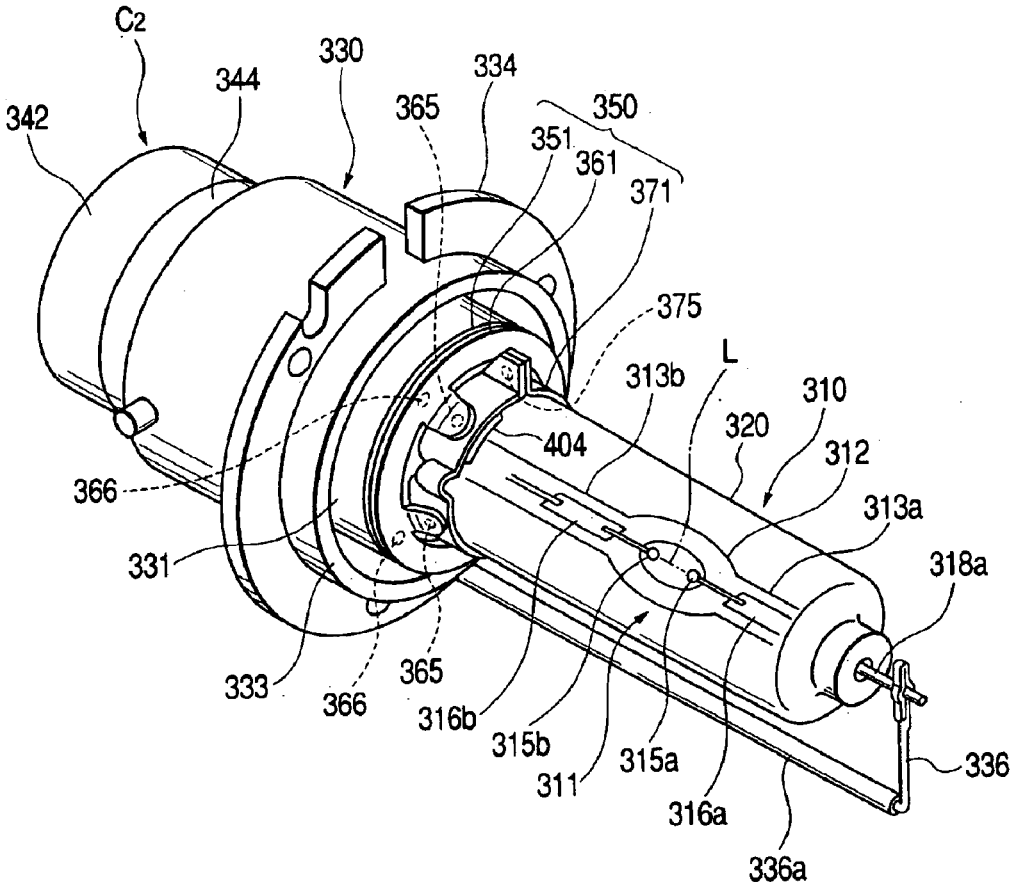
FIG. 10 is a perspective view of a discharge lamp device which is a first embodiment of the invention.
Figure 11:
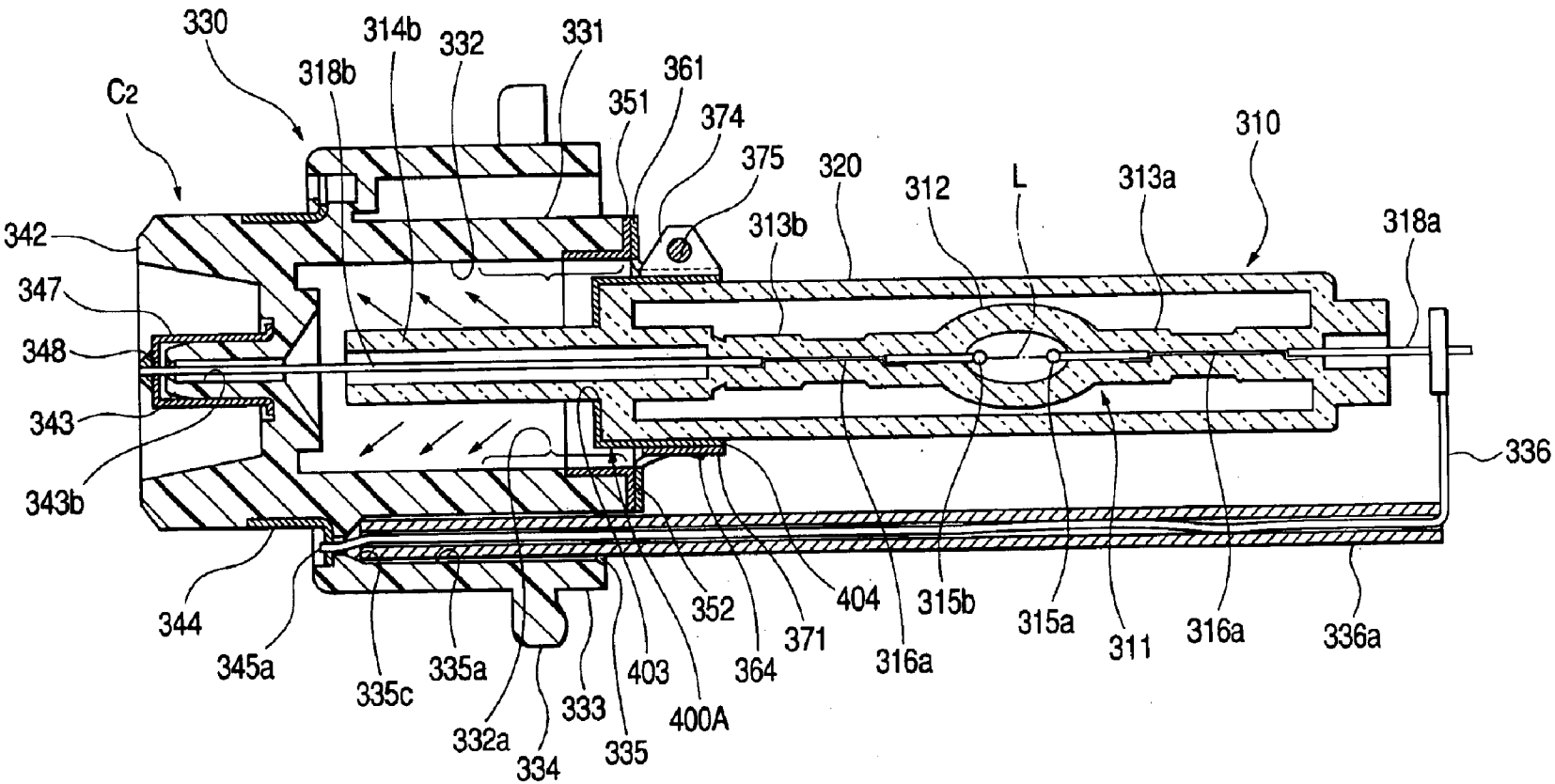
FIG. 11 is a longitudinal section view of the discharge lamp device.
Figure 12:
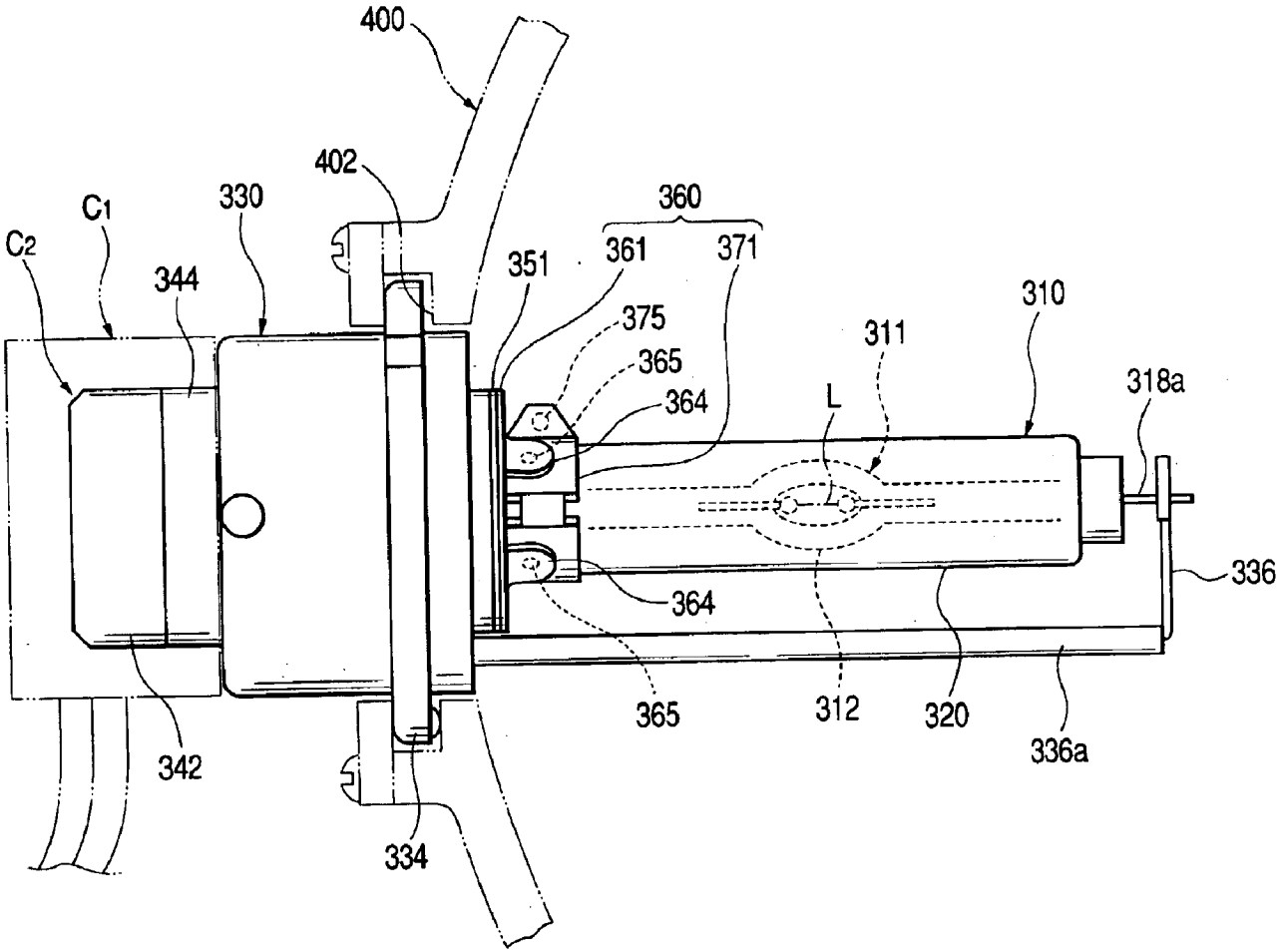
FIG. 12 is a side view of the discharge lamp device.
Figure 13:
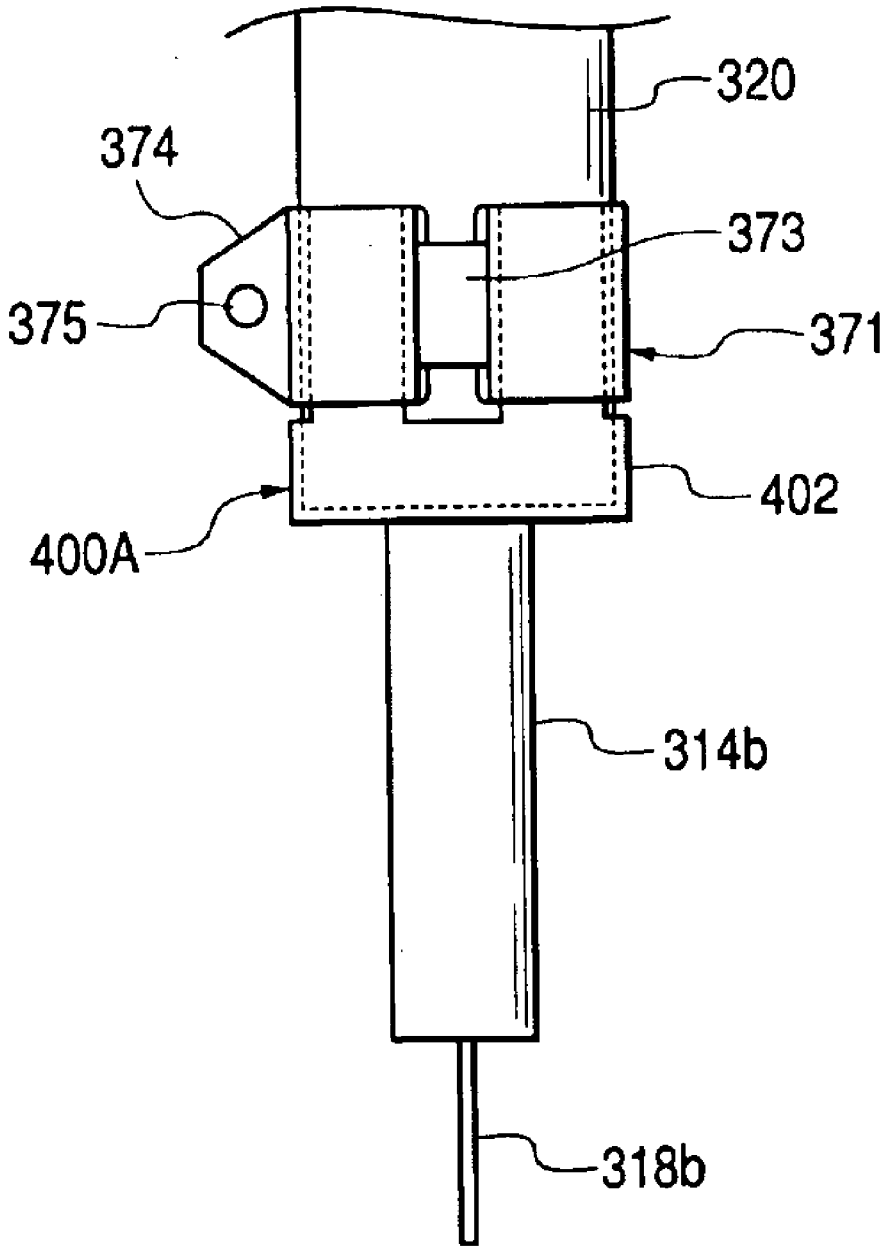
FIG. 13 is a side view of a rear end side of the arc tube body to which a metal light blocking member that is a main portion of the discharge lamp device is attached.
Figure 14:
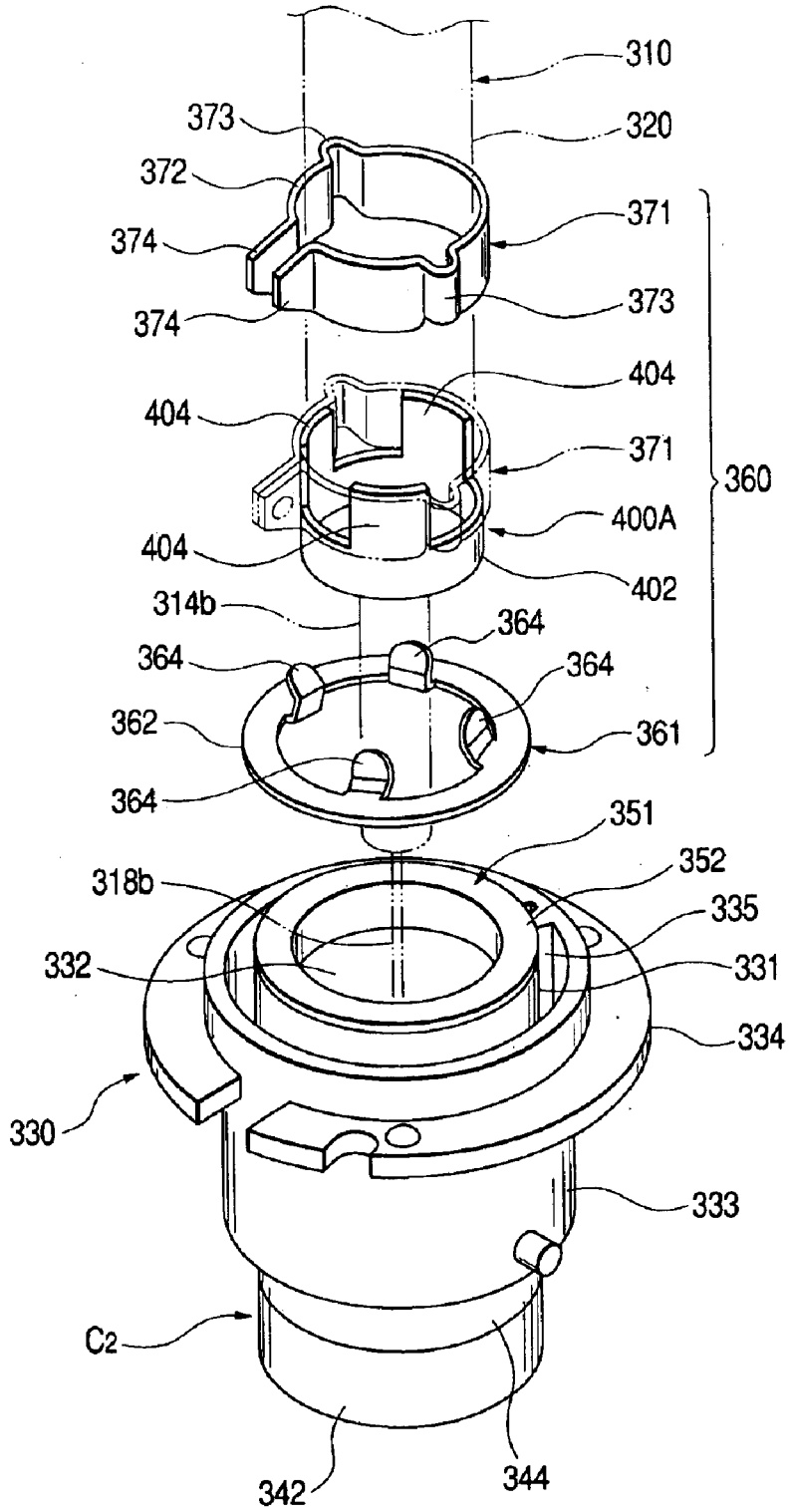
FIG. 14 is an exploded perspective view of a member of fixing and holding a rear end portion of shroud glass, and a light blocking member.

FIGS. 10 to 14 show a fifth embodiment of the invention. FIG. 10 is a perspective view of a discharge lamp device which is the fifth embodiment of the invention, FIG. 11 is a longitudinal section view of the discharge lamp device, FIG. 12 is a side view of the discharge lamp device, FIG. 13 is an exploded perspective view of a supporting member which fixingly supports a rear end portion of shroud glass, and FIG. 14 is a section view showing a UV blocking film forming region in the arc tube body. FIG. 13 is a side view of a rear end side of the arc tube body to which a metal light blocking member that is a main portion of the discharge lamp device is attached, and FIG. 14 is an exploded perspective view of a member of fixing and holding a rear end portion of shroud glass, and a light blocking member.

In the figures, the reference numeral 330 denotes an insulating plug which is made of PPS resin. A lamp-side connector $C_2$ into which a power supply connector $C_1$ (see FIG. 12) can be inserted is disposed integrally in a rear end portion of the insulating plug. A focusing ring 334 which is engaged with a bulb insertion hole 402 (see FIG. 12) of a reflector 400 of an automotive head lamp is disposed on the outer periphery of the insulating plug. The arc tube body 310 is fixingly supported in front of the insulating plug 330 by a metal lead support 336 which forward elongates from the plug 330, and a metal supporting member 350 which is fixed to the front face of the plug 330, thereby constituting the discharge lamp device.

Specifically, the discharge lamp device is structured in the following manner. A lead wire 318*a* which is drawn out from a front end portion of the arc tube body 310 is fixed by spot welding to a bent front end portion of the lead support 336 elongating from the insulating plug 330. A rear end portion of the arc tube body 310 is gripped by the metal supporting member 350 configured by a base plate 351 which is fixed to the front face of the insulating plug 330, a slide plate 361, and an arc tube gripping band 371.

The arc tube body 310 has a structure in which cylindrical ultraviolet-ray blocking shroud glass 320 is integrally welded (sealingly attached) to an arc tube 311 having a closed glass globe 312 wherein electrodes 315*a* and 315*b* are paired to be opposed to each other, so that the shroud glass 320 encloses and hermetically seals the closed glass bulb 312. The reference character L denotes a discharge axis connecting the electrodes 315*a* and 315*b*.

The arc tube 311 is produced from a quartz glass tube having a circular pipe-like shape, and is structured so that the closed glass globe 312 having a shape of an ellipsoid of revolution is formed at a predetermined position in the longitudinal direction to be interposed between pinch seal portions 313*a* and 313*b* having a rectangular cross section shape. The glass globe 312 is filled with a rare gas for starting, mercury, and a metal halide (for example, a sodium-scandium light emitting substance). Rectangular molybdenum foils 316*a* and 316*b* are sealed in the pinch seal portions 313*a* and 313*b*, respectively. In the molybdenum foils 316*a* and 316*b*, the electrodes 315*a* and 315*b* which are opposed to each other in the closed glass globe 312 are connected to one side, and lead wires 318*a* and 318*b* which are drawn to the outside of the arc tube 311 are connected to the other side. The region of the arc tube 311 extending from the pinch seal portions 313*a* and 313*b* to the closed glass globe 312 is is enclosed and hermetically sealed by the shroud glass 320. A rearward elongating portion 314*b* (see FIG. 11) which is a non-pinch seal portion of the arc tube 311, and which has a circular pipe-like shape elongates in the rear of the shroud glass 320.

The shroud glass 320 is configured by quartz glass into which $TiO_2$ and $CeO_2$ are doped, and which has a function of blocking ultraviolet rays, so that ultraviolet rays in a wavelength region harmful to the human body are surely cut off from light emitted from the closed glass globe 312 serving as a discharging portion. The interior of the shroud glass 320 is set to a vacuum state or a inert gas-filled state, and designed so as to exert a heat insulating function with respect to radiation of heat from the closed glass globe 312 serving as a discharging portion, thereby preventing the lamp characteristics from being affected by a change of the external environment.

A cylindrical inner tube portion 331 having an opening 332 in which the rearward elongating portion 314*b* of the arc tube 311 can be inserted and housed is formed in the front face side of the insulating plug 330. A cylindrical outer tube portion 333 around which the focusing ring 334 is disposed is formed around the inner tube portion 331 except a bridge portion 335 in which a lead support insertion hole 335*a* is formed. An insulating sleeve 336*a* which is made of ceramics, and through which is the lead support 336 is passed is inserted into the lead support insertion hole 335*a*. A rear end portion of the lead support 336 which is passed through the insulating sleeve 336*a* rearward is projected from a tapered hole 335*c* (see FIG. 11) which is opened in the back face of the insulating plug 330, passed through a lead support engaging hole 345*a* of a belt-type terminal 344 which is disposed in a rear end portion of the insulating plug 330, and then laser-welded thereto.

The cylindrical base plate 351 made of a metal is closely fixed to the front edge of the inner tube portion 331. The base plate 351 is integrated with the insulating plug 330 in the form in which a disk-like basal portion 352 (see FIG. 13) is exposed, by insert molding in which injection molding is conducted in a state where the base plate 351 is inserted into a mold.

A vertically holding member 360 which is made of a metal, and which is configured by the slide plate 361 made of a metal and the arc tube gripping band 371 made of a metal to vertically hold the shroud glass 320 of the arc tube body 310 is joined and fixed to the disk-like basal portion 352 of the base plate 351 integrated with the insulating plug 330, and placed so that the discharge axis L of the arc tube body 310 coincides with the center axis of the focusing ring 334.

Specifically, in the arc tube gripping band 371 is constituting the vertically holding member 360*a*, rectangular tag pieces 374 which are bent into an L-like section shape are formed in butting end portions of the belt-like band body 372, respectively. The tag pieces 374 of the band body 372 which is wound around the shroud glass 320 of the arc tube body 310 are butt each other, and then spot-welded together, whereby the gripping band 371 can be wound and fixed to the shroud glass 320. The reference numeral 373 denotes bent portions which are disposed in two longitudinally separated places of the band body 372, respectively. When the bent portions 373 are elastically deformed, the band body 372 expands or contracts. This allows the band body 372 to be wound and fixed to the shroud glass 320. The reference numeral 375 denotes a spot-welded portion.

In the metal slide plate 361 constituting the vertically holding member 360, as shown in FIG. 14, the basal portion 362 is formed into a doughnut-like disk shape which matches the disk-shaped basal portion 352 of the base plate 351, and four plate spring-like clamping tongue pieces 364 which are cut and raised are disposed on the inner peripheral edge of the basal portion 362 at regular intervals in the circumferential direction. The outer periphery of the arc tube gripping band 371 which is wound and fixed to the shroud glass 320 of the arc tube body 310 is clamped by the clamping tongue pieces 364, and the clamping tongue pieces 364 are laser-welded to the gripping band 371, whereby the arc tube body 310 is integrated with the slide plate 361 so that the discharge axis L of the arc tube body 310 is perpendicular to the joining face of the slide plate 361 (the lower face of the doughnut-like disk basal portion 362 of the slide plate 361) with respect to the base plate 351, and in a position which is separated from the lower face of the basal portion 362 by a predetermined distance. The reference numerals 365 and 366 denote laser-welded portions.

A cylindrical outer tube portion 342 which rearward elongates, and a columnar boss 343 which rearward elongates is to be passed is formed in the bottom face of the cylinder portion 402. Three upward extended pieces 404 are disposed on an upper edge portion of the cylinder portion 402. The rearward elongating portion 314*b* of the arc tube is passed through the hole 403, the light blocking member 400A (the cylinder portion 402) covers the rear end portion of the shroud glass 320, and the gripping band 371 is wound and fixed onto the three upward extended pieces 404 as indicated by the phantom lines in FIG. 14, whereby the light blocking member 400A is fixed and integrated with the rear end portion of the shroud glass 320.

Therefore, the embodiment is configured so that light (leakage light) which tires to be emitted from the rear end portion of the shroud glass 320 is blocked by the light blocking member 400A and hence cannot be emitted, and the amount of ultraviolet rays to which the resin layer in the region indicated by the reference numeral 332*a* and on the side of the inlet in the opening 332 of the insulating plug is exposed is reduced, thereby preventing the resin layer from being subjected to UV degradation or the like. As indicated by the arrows in FIG. 11, leakage light from the rearward elongating portion 314*b* of the arc tube irradiates the interior of the opening 332. During the course to the rearward elongating portion 314*b* which is remote from the discharging portion, however, the energy of the light which is guided in the glass is gradually lost, in the outer tube portion 342 are formed on the rear end portion of the insulating plug 330. The belt-type terminal 344 having a cylindrical shape and constituting a minus terminal of the lamp-side connector $C_2$ is fixed and integrated with the outer periphery of a root portion of the outer tube portion 342. A cap type terminal 347 constituting a plus terminal of the lamp-side connector is coveringly attached to the boss 343 to be integrated therewith. The reference numeral 348 denotes a lead wire engaging hole which is disposed in a top portion of the cap type terminal 347. The lead wire 318*b* which is drawn out from the rear end side of the arc tube body 310, and which is passed through the opening 332 of the insulating plug 330 and a lead wire insertion hole 343*b* is engaged with the engaging hole 348 and laser-welded thereto.

As shown FIGS. 11, 13, and 14, a metal light blocking member 400A having a shape of a bottomed cylinder is coveringly attached to the rear end portion of the shroud glass 320, so as to form a configuration in which the rear end portion of the shroud glass exposed from the gripping band 371 is covered by the light blocking member 400A specifically, the light blocking member 400A has a bottomed cylinder portion 402 of a size which allows the portion to is coveringly attached to the rear end portion of the shroud glass 320. A hole 403 (see FIG. 11) through which the rearward elongating portion 314*b* of the arc tube with the result that the energy of light (leakage light) which is emitted from the rearward elongating portion 314*b* is weaker than that of light (leakage light) which is emitted from the rear end portion of the shroud glass 320. Therefore, the leakage light is so weak that it does not exert an adverse influence such as UV degradation on the resin layer in the opening 332.

Also the metal gripping band 371 and the metal slide plate 361 function as the light blocking member which blocks leakage light from the rear end portion of the shroud glass 320, and also the base plate 351 which is disposed on the peripheral edge portion of the opening 332 prevents the resin layer on the rear face of the base plate 351 from being exposed to ultraviolet rays. Therefore, UV degradation of the resin layer in the opening 332 is surely prevented from occurring.

Figure 15A:
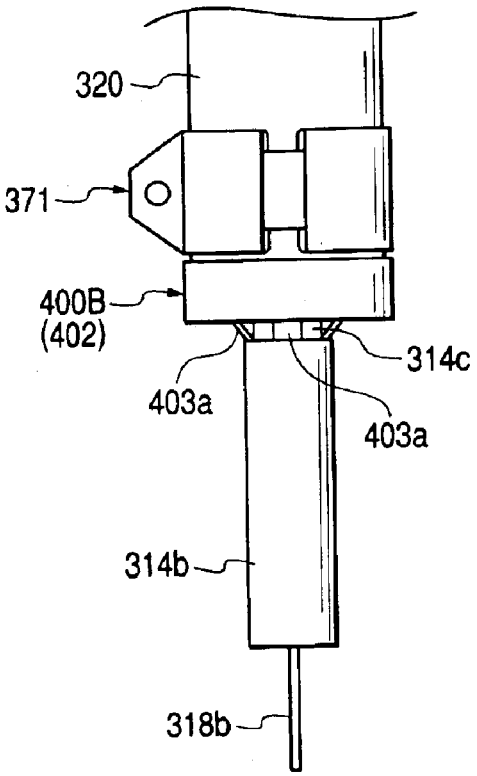
FIG. 15(*a*) is a side view of a rear end side of the arc tube body to which a metal light blocking member that is a main portion of a discharge lamp device of a second embodiment of the invention is attached.
Figure 15B:
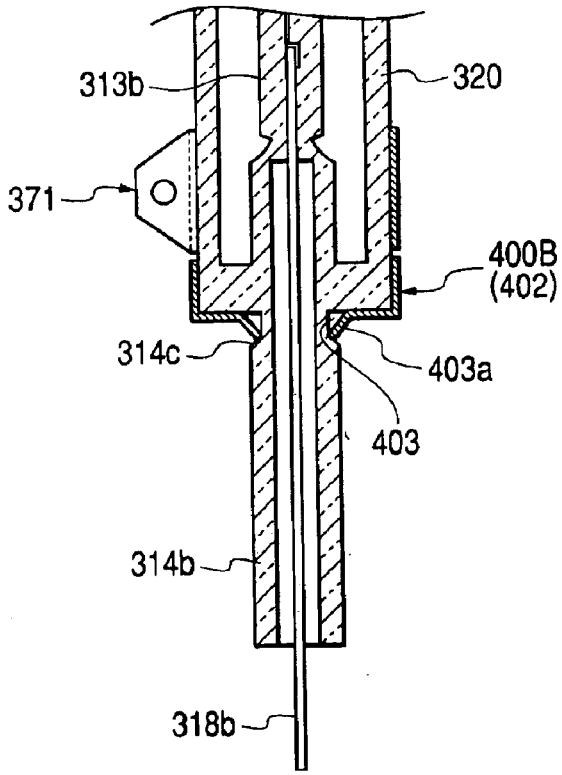
Figure 16:
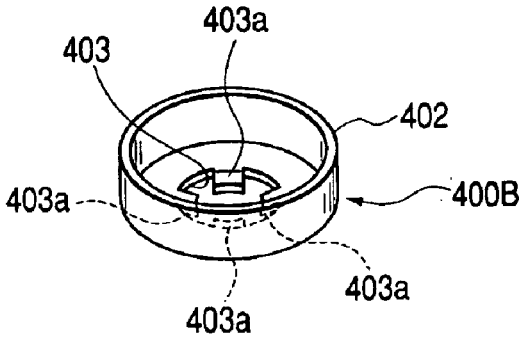
FIG. 16 is a perspective view of the metal light blocking member that is a main portion of the second embodiment.

FIGS. 15 and 16 show a sixth embodiment of the invention (an embodiment corresponding to the thirteenth aspect of the invention). FIG. 15(*a*) is a side view of a rear end side of the arc tube body to which a metal light blocking member that is a main portion of a discharge lamp device of the sixth embodiment of the invention is attached, FIG. 15(*b*) is a longitudinal section view of the rear end side of the arc tube body, and FIG. 16 is a perspective view of the metal light blocking member that is a main portion.

The embodiment described above is configured so that the metal light blocking member is fixed to the rear end portion of the shroud glass by the gripping band 371. By contrast, the sixth embodiment is configured so that a metal light blocking member 400B is singly fixed and held to the rear end portion of the shroud glass.

In the same manner as the embodiment described above, the light blocking member 400B has the bottomed cylinder portion 402 of a size which allows the portion to be coveringly attached to the rear end portion of the shroud glass 320. The hole 403 through which the rearward elongating portion 314*b* of the arc tube is to be passed is formed in the bottom face of the cylinder portion. In the peripheral edge portion of the hole 403, four claws 403*a* serving as elastic engaging pieces are formed by notching and raising the portion. On the other hand, a constricted portion 314*c* with which the claws 403*a* of the light blocking member 400B are to be elastically engaged is formed around the root portion of the rearward elongating portion 314*b* of the arc tube. When the rearward elongating portion 314*b* of the arc tube is passed through the hole 403 and the light blocking member 400B (the cylinder portion 402) is pressed so as to cover the rear end portion of the shroud glass 320, the claws 403*a* of the light blocking member 400A are automatically elastically engaged with the constricted portion 314*c* of the rearward elongating portion 314*b*, and the light blocking member 400B is retainingly held in a state where the member is coveringly attached to the rear end portion of the shroud glass 320.

Figure 17A:
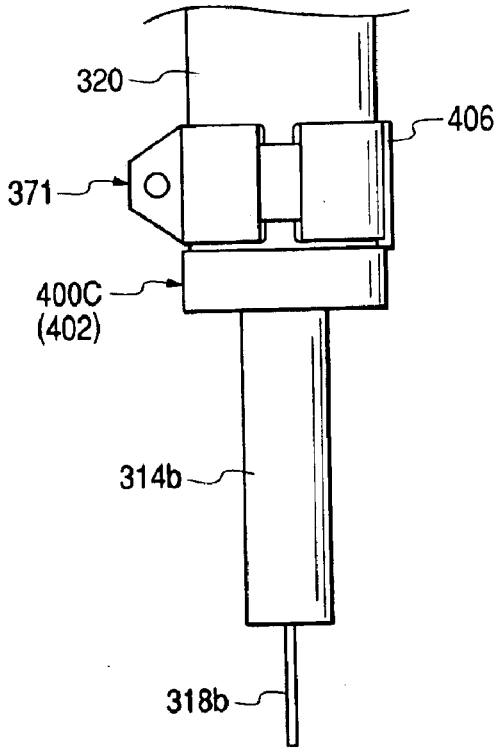
FIG. 17(*a*) is a side view of a rear end side of the arc tube body to which a metal light blocking member that is a main portion of a discharge lamp device of a third embodiment of the invention is attached.
Figure 17B:
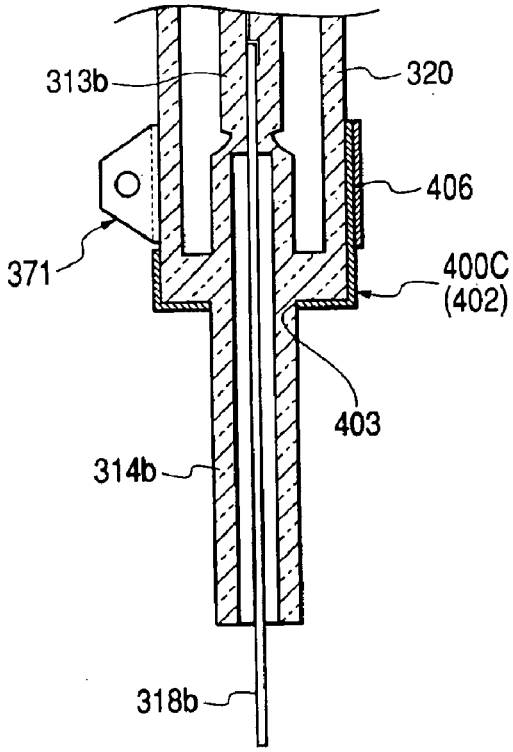
Figure 18:
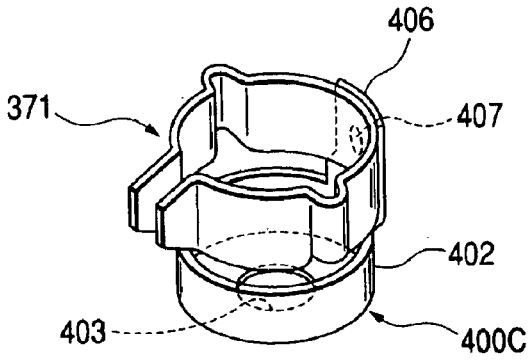
FIG. 18 is a perspective view of the metal light blocking member that is a main portion of the third embodiment.

FIGS. 17 and 18 show a seventh embodiment of the invention (an embodiment corresponding to the ninth aspect of the invention). FIG. 17(*a*) is a side view of a rear end side of the arc tube body to which a metal light blocking member that is a main portion of a discharge lamp device of the seventh embodiment of the invention is attached, FIG. 17(*b*) is a longitudinal section view of the rear end side of the arc tube body, and FIG. 18 is a perspective view of the metal light blocking member that is a main portion.

In the fifth and sixth embodiments described above, the metal light blocking members 400A and 400B are configured separately from the gripping band 371 constituting the metal supporting member 350 which fixingly supports the rear end portion of the shroud glass on the insulating plug 330. The seventh embodiment is structured so that a metal light blocking member 400C is previously integrated with the gripping band 371 constituting the metal supporting member 350.

Specifically, also the metal light blocking member 400C in the seventh embodiment has the bottomed cylinder portion 402 of a size which allows the portion to be coveringly attached to the rear end portion of the shroud glass 320, and the hole 403 through which the rearward elongating portion 314*b* of the arc tube is to be passed is formed in the bottom face of the cylinder portion. A connecting piece 406 for connection with the gripping band 371 is disposed on an upper edge portion of the cylinder portion 402. The light blocking member 400C is previously integrated with the gripping band 371 by spot-welding the connecting piece 406 to the band body 372 of the gripping band 371. At the same time when the gripping band 371 is attached to the rear end portion of the shroud glass 320, the light blocking member 400C is fixed and held in a state where the member is coveringly attached to the rear end portion of the shroud glass 320. The reference numeral 407 denotes a spot-welded portion.

Figure 19A:
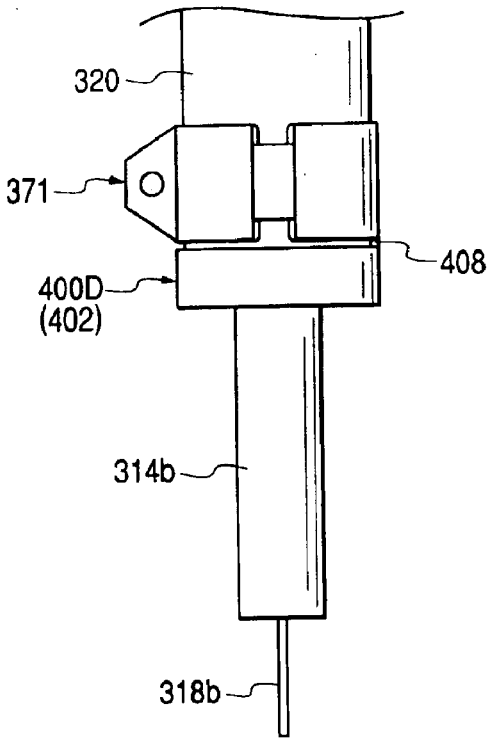
FIG. 19(*a*) is a side view of a rear end side of the arc tube body to which a metal light blocking member that is a main portion of a discharge lamp device of a fourth embodiment of the invention is attached.
Figure 19B:
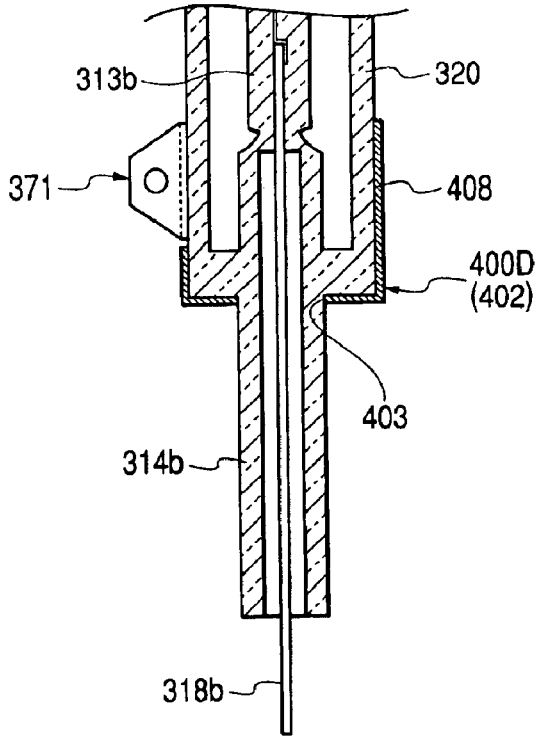
Figure 20:
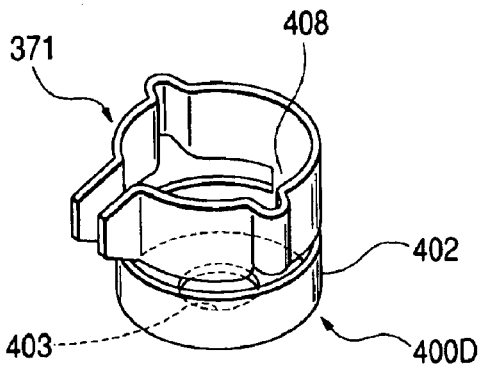
FIG. 20 is a perspective view of the metal light blocking member that is a main portion of the fourth embodiment.

FIGS. 19(*a*), 19(*b*) and 20 show an eighth embodiment is of the invention (an embodiment corresponding to the ninth aspect of the invention). FIG. 19(*a*) is a side view of a rear end side of the arc tube body to which a metal light blocking member that is a main portion of a discharge lamp device of the eighth embodiment of the invention is attached, FIG. 19(*b*) is a longitudinal section view of the rear end side of the arc tube body, and FIG. 20 is a perspective view of the metal light blocking member that is a main portion.

The seventh embodiment described above is structured so that the metal light blocking member 400C is integrated with the gripping band 371 by welding. By contrast, the eighth embodiment is structured so that a metal light blocking member 400D is previously integrated with the gripping band 371 via a continuously connecting portion 408.

For example, a sheet metal is pressed to be cut into a predetermined shape in which a region for forming the gripping band 371 is connected to that for forming the light blocking member 400D via the continuously connecting portion 408. Thereafter, the region for forming the light blocking member 400D is shaped into a cylindrical shape by a drawing process, and that for forming the gripping band 371 is shaped into a predetermined shape by a bending process, thereby obtaining a shaped member in which the gripping band 371 and the light blocking member 400D are continuously integrated with each other.

The other components are identical with those of the embodiment described above, and denoted by the same reference numerals. Therefore, their duplicated description will be omitted.

Figure 21:
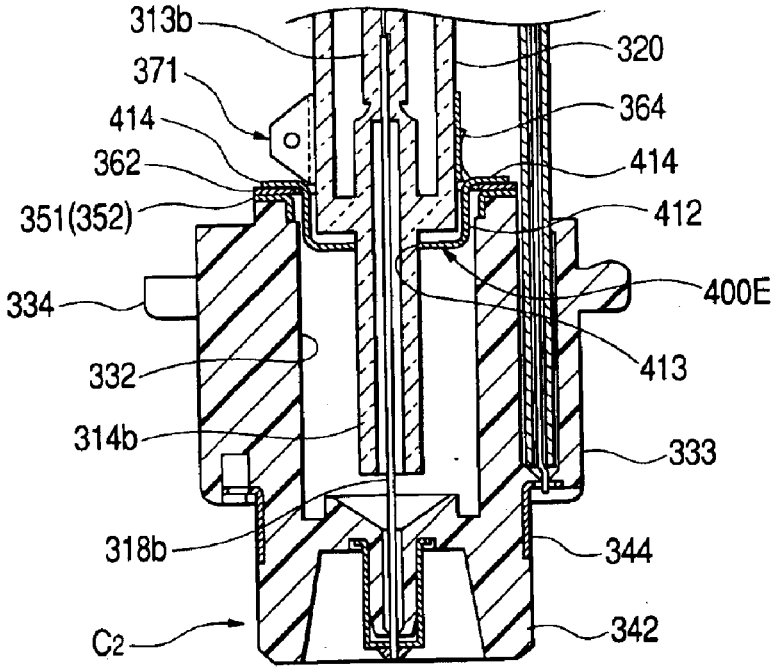
FIG. 21 is a longitudinal section view of main portions of a discharge lamp device which is a fifth embodiment of the invention.
Figure 22:
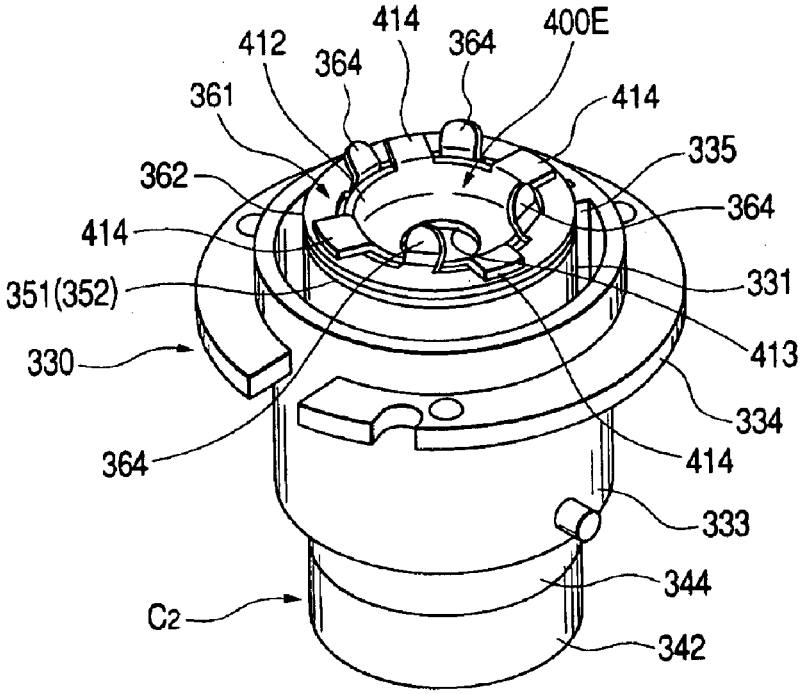
FIG. 22 is a perspective view of main portions of the discharge lamp device.

FIGS. 21 and 22 show a ninth embodiment of the invention (an embodiment corresponding to the tenth aspect of the invention). FIG. 21 is a longitudinal section view of main portions of a discharge lamp device of the ninth embodiment of the invention, and FIG. 22 is a perspective view of main portions of the discharge lamp device.

In the fifth to eighth embodiments described above, the metal light blocking members 400A, 400B, 400C, and 400D are coveringly attached to the rear end portion of the shroud glass 320. By contrast, in the ninth embodiment, a metal light blocking member 400E is integrated by welding with the slide plate 361 constituting the metal supporting member 350, and held in the opening 332 so as to be loosely fitted on the rear end portion of the shroud glass 320.

Specifically, the metal light blocking member 400E has a bottomed cylinder portion 412 of a size which allows the portion to be loosely fitted on the rear end portion of the shroud glass 320, a hole 413 through which the rearward elongating portion 314*b* of the arc tube is to be passed is formed in the bottom face of the cylinder portion, and four flanges 414 are disposed on a peripheral edge portion on the side of the opening. The flanges 414 are fixed and integrated by spot-welding with the annular basal portion 362 of the metal slide plate 361 so as not to interfere with the tongue-like clamping pieces 364 of the slide plate 361.

In the embodiment, leakage light (containing UV components) which is emitted from the rear end portion of the shroud glass 320 and directed toward the interior of the front opening 332 of the insulating plug 330 is blocked by the metal light blocking member 400E which is placed so as to enclose the rear end portion of the shroud glass 320, and hence does not reach the interior of the front opening 332 of the insulating plug. Therefore, the amount of ultraviolet rays to which the resin layer in the front opening 332 is exposed is reduced, and the resin layer is prevented from being subjected to UV degradation or the like.

The slide plate 361 is a member which, when to be welded and fixed to the base plate 351, is slid on the base plate 351 to adjust the tilting of the arc tube body 310 so that the discharge axis L of the arc tube body 310 is in a predetermined position with respect to the focusing ring 334. In the adjustment of the position of the discharge axis L of the arc tube body, therefore, also the light blocking member 400E which is integrated with the slide plate 361 is slid together with the slide plate 361 in an integral manner, and the tilting of the arc tube body 310 is adjusted. Consequently, the hole 413 through which the rearward elongating portion 314*b* of the arc tube is to be passed, and which is opened in the bottom face of the cylinder portion 412 is formed so as to be slightly larger than the outer diameter of the rearward elongating portion 314*b* of the arc tube, whereby the hole 413 is prevented from interfering with (the rearward elongating portion 314*b* of) the arc tube when the position of the slide plate 361 (the position of the discharge axis L) is adjusted.

Figure 23:
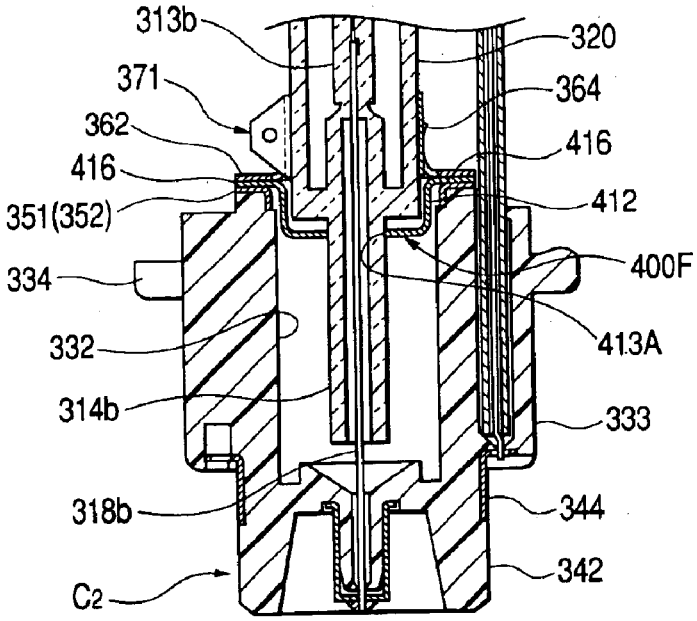
FIG. 23 is a longitudinal section view of main portions of a discharge lamp device which is a sixth embodiment of the invention.
Figure 24:
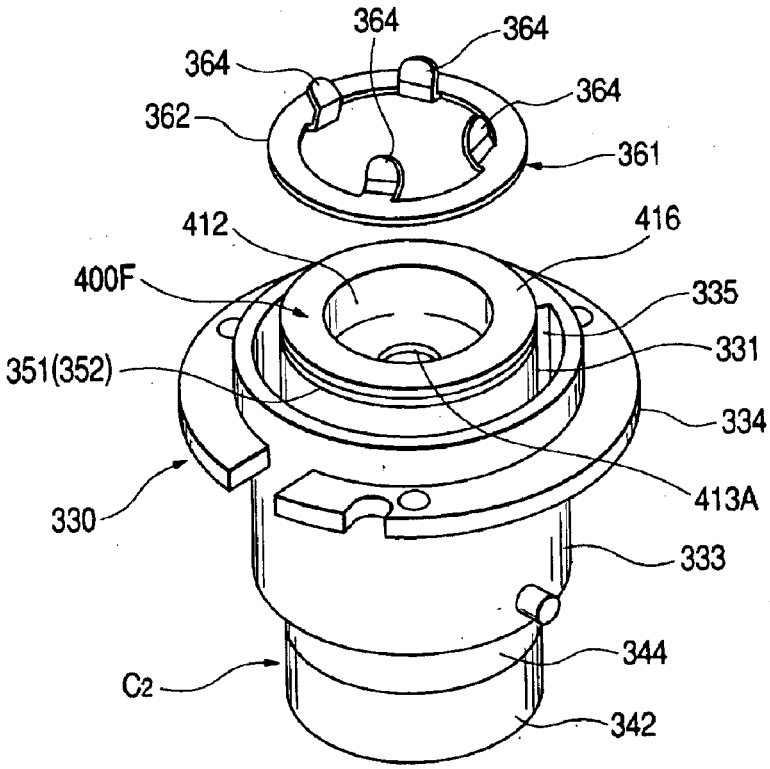
FIG. 24 is a perspective view of main portions of the discharge lamp device.

FIGS. 23 and 24 show a tenth embodiment of the invention (an embodiment corresponding to the eleventh aspect of the invention). FIG. 23 is a longitudinal section view of main portions of a discharge lamp device of the tenth embodiment of the invention, and FIG. 24 is a perspective view of main portions of the discharge lamp device.

The ninth embodiment described above is structured so that the metal light blocking member 400E is integrated by welding with the slide plate 361 constituting the metal supporting member 350. By contrast, the tenth embodiment is characterized in that a metal light blocking member 400F is clampingly integrated between the slide plate 361 and the base plate 351 which constitute the metal supporting member 350.

In the same manner as the ninth embodiment, the metal light blocking member 400F has the bottomed cylinder portion 412 of a size which allows the portion to be loosely fitted on the rear end portion of the shroud glass 320, a hole 413A through which the rearward elongating portion 314*b* of the arc tube is to be passed is formed in the bottom face of the cylinder portion, and an annular flange 416 is disposed on a peripheral edge portion on the side of the opening. The flange 416 is fixed and integrated by spot-welding in a state where the flange is clamped between the annular basal portion 352 of the base plate 351 and the annular basal portion 362 of the slide plate 361.

The metal light blocking member 400F is fixed in the following manner. First, the metal light blocking member 400F is placed on the base plate 351, and the slide plate 361 is placed on the member. Then, the rearward elongating portion 314*b* of the arc tube in which the gripping band 371 is wound and fixed to the shroud glass 320 is passed through the hole 413A of the metal light blocking member 400F on the base plate 351, and held so that the tongue-like clamping pieces 364 of the slide plate 361 elastically support the gripping band 371 on the outer periphery of the shroud glass 320. The slide plate 361 is moved along the base plate 351 so that the discharging portion is located in a predetermined position with respect to the focusing ring 334. The annular basal portion 352 of is the base plate 351 and the annular basal portion 362 of the slide plate 361 which clamp the flange 416 of the light blocking member 400F are fixed together by spot-welding.

In the adjustment of the tilting of the arc tube in which the slide plate 361 is slid, the metal light blocking member 400F can be slid with respect to the slide plate 361 and the base plate 351. Therefore, the hole 413A through which the rearward elongating portion 314*b* of the arc tube is to be passed, and which is formed in the bottom face of the bottomed cylinder portion 412 of the light blocking member 400F is not required to be largely formed unlike the hole 413 which is formed in the light blocking member in the ninth embodiment. As a result, the hole can have a size which substantially matches the outer diameter of the rearward elongating portion 314*b* of the arc tube.

Figure 25:
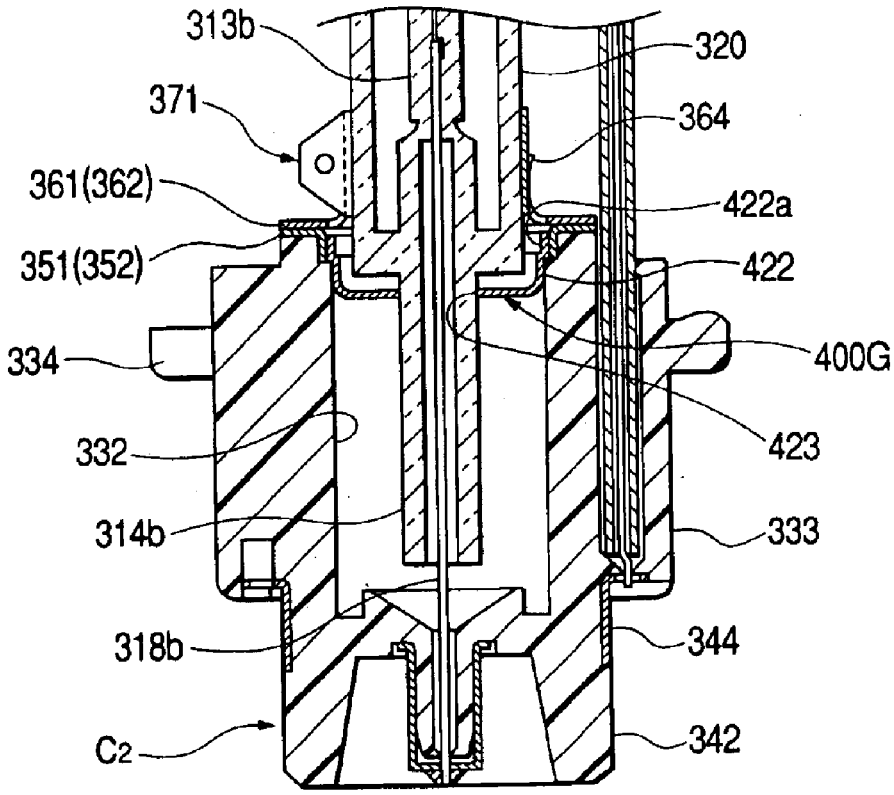
FIG. 25 is a longitudinal section view of main portions of a discharge lamp device which is a seventh embodiment of the invention.
Figure 26:
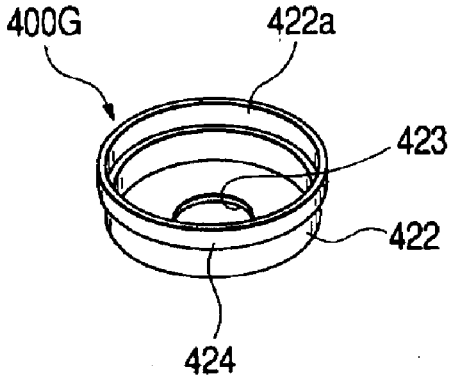
FIG. 26 is a perspective view of a metal light blocking member which is a main portion of the discharge lamp device.

FIGS. 25 and 26 show a eleventh embodiment of the invention (an embodiment corresponding to the twelfth aspect of the invention). FIG. 25 is a longitudinal section view of main portions of a discharge lamp device of the eleventh embodiment of the invention, and FIG. 26 is a perspective view of a metal light blocking member which is a main portion of the discharge lamp device.

The ninth and tenth embodiments described above are structured so that the metal light blocking members 400E and 400F are fixed and integrated by welding to the metal supporting member 350. By contrast, in the eleventh is embodiment, a metal light blocking member 400G is pressingly inserted into the front opening 332 of the insulating plug 330 to be fixed thereto.

In a peripheral edge portion 422*a* on the side of the opening in the bottomed cylinder portion 412 constituting the light blocking member 400G, a step portion 424 which sets the amount of the pressing insertion of the light blocking member 400G into the front opening 332 is formed.

The reference numeral 423 denotes a hole through which the rearward elongating portion 314*b* of the arc tube is to be passed, and which is formed in the bottom of the bottomed cylinder portion 412. The hole is formed to be slightly large so as not to impede the positional adjustment of the slide plate 361 (the positional adjustment of the discharge axis L).

Furthermore, (the annular basal portion 362 of) the slide plate 361 constituting the metal supporting member 350 functions as a retaining member which retains the light blocking member 400F that is pressingly inserted into the front opening 332 of the insulating plug 330.

In the embodiment, leakage light (containing UV components) which is emitted from the rear end portion of the shroud glass 320 and directed toward the interior of the front opening 332 of the insulating plug 330 is blocked by the metal light blocking member 400G which is placed in the vicinity of the front opening 332 of the insulating plug, and hence does not reach the resin layer of the front opening 332. Therefore, the amount of ultraviolet rays to which the resin layer in the opening 332 of the insulating plug is exposed is reduced, and the resin layer is prevented from being subjected to UV degradation or the like.

Figure 27:
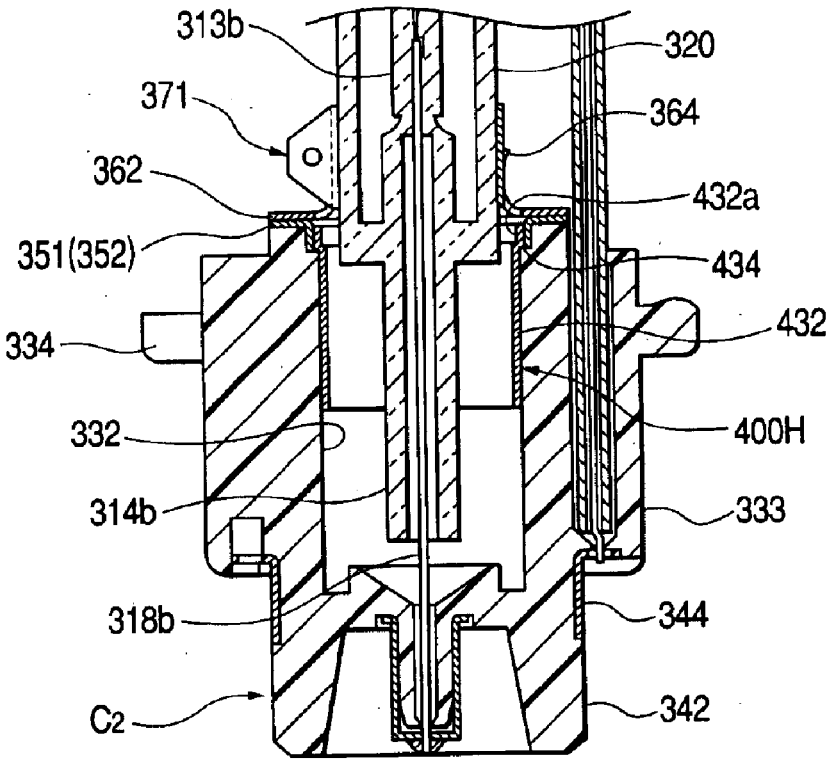
FIG. 27 is a longitudinal section view of main portions of a discharge lamp device which is an eighth embodiment of the invention.
Figure 28:
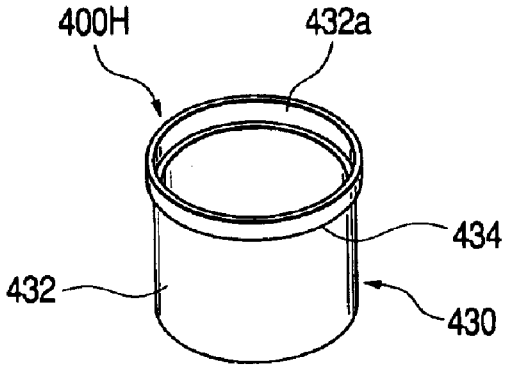
FIG. 28 is a perspective view of a metal light blocking member which is a main portion of the discharge lamp device.
Figure 29:
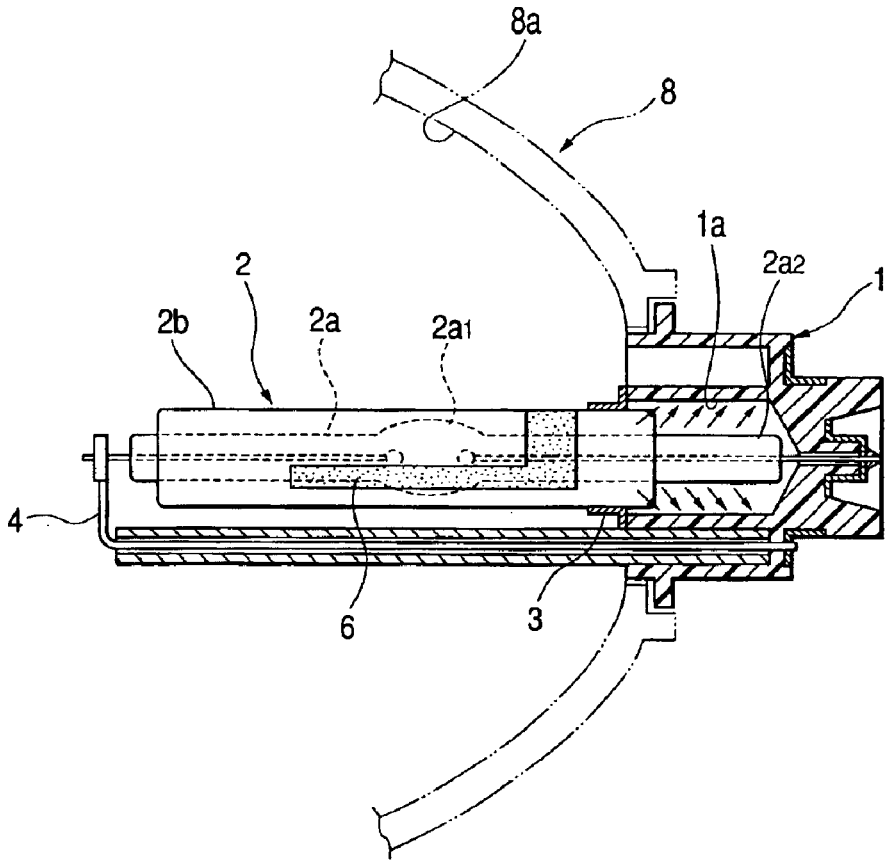
FIG. 29 PRIOR ART
FIG. 29 is a longitudinal section view of a conventional discharge lamp device.
Figure 30:
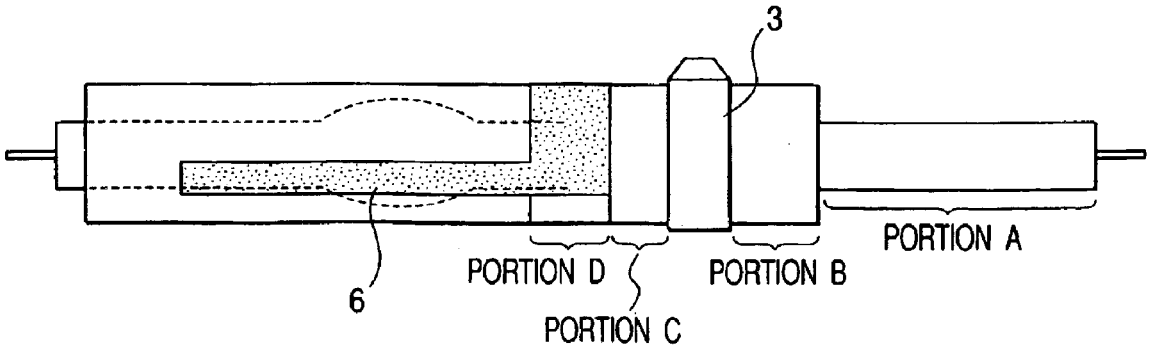
FIG. 30 is a view showing positions where a UV blocking film is formed in the arc tube body used in experiments.

FIGS. 27 and 28 show an twelfth embodiment of the invention (an embodiment corresponding to the twelfth aspect). FIG. 27 is a longitudinal section view of main portions of a discharge lamp device of the twelfth embodiment of the invention, and FIG. 28 is a perspective view of a metal light blocking member which is a main portion of the discharge lamp device.

In the eleventh embodiment described above, the metal light blocking member 400G is formed into a shape of a bottomed cylinder. In the embodiment, a metal light blocking member 400H is formed into a shape of a bottomless cylinder, and pressingly inserted into the front opening 332 of the insulating plug 330 to be fixed thereto.

The length of a cylinder 432 constituting the light blocking member 400H corresponds to the region 332*a* (see FIG. 11) in the front opening 332 which is irradiated with leakage light from the rear end portion of the shroud glass 320.

In the same manner as the eleventh embodiment, a step portion 434 which sets the amount of the pressing insertion of the light blocking member 400H into the front opening 332 is formed in a peripheral edge portion 432*a* on the side of the upper opening in the cylinder 432, and (the disk-like basal portion 362 of) the slide plate 361 constituting the metal supporting member 350 functions as a retaining member which retains the light blocking member 400G that is pressingly inserted into the front opening 332.

In the embodiment, leakage light (containing UV components) which is emitted from the rear end portion of the shroud glass 320 and directed toward the interior of the front opening 332 of the insulating plug 330 is blocked by the metal light blocking member 400H which is disposed along the inner peripheral face of the front opening 332 of the insulating plug, and hence does not reach the resin layer on the rear of the light blocking member 400H. Therefore, the amount of ultraviolet rays to which the resin layer in the opening 332 of the insulating plug is exposed is reduced, and the resin layer is prevented from being subjected to UV degradation or the like.

As apparent from the above description, in the discharge lamp device of the invention, UV components of leakage light from the rearward elongating portion of the arc tube are cut off, and the amount of ultraviolet rays to which the front opening of the insulating plug made of a synthetic resin is exposed is reduced. Therefore, defects such as degradation of the insulating plug, particularly a defect that an organic gas is generated by irradiating an insulating plug made of PPS resin with ultraviolet rays and an effective reflecting surface of a lamp reflector is tarnished or clouded by the organic gas are not caused.

Since the UV blocking film cannot be seen through a front lens, a lighting device has an excellent appearance.

According to the second aspect of the invention, UV components of leakage light from the rearward elongating portion of the arc tube are cut off, and light which contains UV components, and which is transmitted through the rear end portion of the shroud glass does not reach the front opening of the insulating plug. Therefore, the amount of ultraviolet rays to which the front opening of the insulating plug made of a synthetic resin is exposed is further reduced, and the possibility that defects such as degradation of the insulting plug occur is further lowered.

The UV blocking film in the front opening of the insulting plug is surely hidden by the light blocking member, and hence a lighting device has a more excellent appearance.

According to the third aspect of the invention, UV components of leakage light from the rearward elongating portion of the arc tube are cut off, and light which contains UV components, and which is transmitted through is the rear end portion of the shroud glass is blocked by the cylindrical light blocking member so as not to reach the resin layer on the rear side of the light blocking member. Therefore, the possibility that defects such as degradation of the insulting plug occur is further lowered.

According to the discharge lamp device of the fourth aspect, UV components of leakage light from the rearward elongating portion of the arc tube are cut off, and light which contains UV components, and which is transmitted through the rear end portion of the shroud glass is blocked by the light blocking member in the inlet of the front opening of the insulating plug, and further blocked by the cylindrical light blocking member for preventing UV degradation which is disposed along the opening. Therefore, the amount of ultraviolet rays to which the resin layer constituting of the front opening of the insulating plug made of a synthetic resin is exposed is remarkably reduced, and the possibility that defects such as degradation of the insulting plug occur never arises.

The UV blocking film in the front opening of the insulting plug is surely hidden by the light blocking member, and hence a lighting device has a more excellent appearance.

According to the fifth aspect of the invention, leakage light containing UV components and emitted from the rearward elongating portion of the arc tube and/or the rear end portion of the shroud glass is blocked, and the amount of ultraviolet rays to which the front opening of the insulating plug is exposed is reduced. Consequently, defects such as degradation of the insulting plug are not caused.

The cylindrical light shade which is coveringly attached to the rearward elongating portion of the arc tube is made of a nonmetallic material. Even when the light shade is used in the insulating plug that generates a high voltage, therefore, there is no possibility of dielectric breakdown, and the safety is ensured.

Since the cylindrical light shade in the front opening of the insulating plug cannot be seen through a front lens, a lighting device has an excellent appearance.

According to the sixth aspect of the invention, UV components of light leaking from the rearward elongating portion of the arc tube are cut off, and the amount of ultraviolet rays to which the front opening of the insulating plug made of a synthetic resin is exposed is reduced. Therefore, defects such as degradation of the insulating plug are not caused. Particularly, a material having properties of blocking UV components which are more excellent than those of the light blocking film may be used in the UV blocking film which is formed on the rearward elongating portion of the arc tube or the rear end portion of the shroud glass, whereby defects such as degradation of the insulating plug are further improved.

When a material having heat resistance which is lower than that of the light blocking film for luminous intensity distribution control is used in the UV blocking film which is formed on the rearward elongating portion of the arc tube or the rear end portion of the shroud glass, the cost of the UV blocking film itself is lowered, and the unnecessariness of heat resistance correspondingly simplifies the facilities and works of forming the UV blocking film, whereby the discharge lamp device can be economically provided.

Since the UV blocking film in the front opening of the insulating plug cannot be seen through a front lens, a lighting device has an excellent appearance.

Further, as apparent from the above description, in the discharge lamp device of the invention, leakage light (containing UV components) from the rear end portion of the shroud glass is blocked by the metal light blocking member which has an economical and simple configuration, and the amount of ultraviolet rays to which the front opening of the insulating plug made of a synthetic resin is exposed is reduced. Therefore, defects such as UV degradation of the insulating plug, particularly a defect that an organic gas is generated by irradiating an insulating plug made of PPS resin with ultraviolet rays and an effective reflecting surface of a reflector is tarnished or clouded by the organic gas are not caused.

According to the eighth aspect of the invention, it is not necessary to additionally dispose fixing means for supporting the metal light blocking member, and hence the structure of fixing and supporting the metal light blocking member is correspondingly simplified.

According to the ninth aspect of the invention, leakage light (containing UV components) from the rear end portion of the shroud glass is surely blocked by the metal light blocking member, and the amount of ultraviolet rays to which the front opening of the insulating plug made of a synthetic resin is exposed is reduced. Therefore, defects such as degradation of the insulating plug are improved.

The light blocking member is enabled to be coveringly attached to the rear end portion of the shroud glass by attaching the metal gripping band to the shroud glass. Therefore, the metal light blocking member can be easily coveringly attached to the rear end portion of the shroud glass, and the structure of fixing and supporting the metal light blocking member is simplified.

According to the tenth aspect of the invention, leakage light (containing UV components) from the rear end portion of the shroud glass is blocked by the metal light blocking member, and the amount of ultraviolet rays to which the front opening of the insulating plug made of a synthetic resin is exposed is reduced. Therefore, defects such as degradation of the insulating plug are improved.

The metal light blocking member is previously integrated with the metal slide plate. At the same time when the metal slide plate is fixed to the insulating plug, therefore, the metal light blocking member can be held to a predetermined position where the member is loosely fitted on the rear end portion of the shroud glass. Consequently, the work of fixing and holding the metal light blocking member to the predetermined position is simply conducted, and the structure of fixing and supporting the metal light blocking member is simplified.

According to the eleventh aspect of the invention, leakage light (containing UV components) from the rear end portion of the shroud glass is blocked by the metal light blocking member, and the amount of ultraviolet rays to which the front opening of the insulating plug made of a synthetic resin is exposed is reduced. Therefore, defects such as degradation of the insulating plug are improved.

When the metal base plate is fixed to the metal slide plate, the metal light blocking member is held to a predetermined position where the member is loosely fitted on the rear end portion of the shroud glass. Consequently, the work of fixing and holding the metal light blocking member to the predetermined position is simply conducted, and the structure of fixing and supporting the metal light blocking member is simplified.

According to the twelfth aspect of the invention, leakage light (containing UV components) from the rear end portion of the shroud glass is blocked by the metal light blocking member, and the amount of ultraviolet rays to which the front opening of the insulating plug made of a synthetic resin is exposed is reduced. Therefore, defects such as degradation of the insulating plug are improved.

Moreover, it is not necessary to additionally dispose means for retaining the metal light blocking member, and hence the structure in the vicinity of the front opening of the insulating plug is not complicated.

According to the thirteenth aspect of the invention, at the same time when the metal light blocking member is coveringly attached to the rear end portion of the shroud glass, the member is retainingly held. Therefore, the metal light blocking member can be easily coveringly attached, and the structure of fixing and supporting the metal light blocking member is very simplified.

What is claimed is:

1. A discharge lamp device comprising:

an arc tube body including an arc tube having a discharging portion, and cylindrical shroud glass enclosing said discharging portion and integrated with an arc tube by welding, an insulating plug made of a synthetic resin and holding a rearward elongating portion of said arc tube in a front opening of said insulating plug, said rearward elongating portion of said arc tube elongating in a rear of said shroud glass; and a metal light blocking member with a portion interposed between a rear end face of said shroud glass and said front opening of said insulating plug, said light blocking member blocking light which is emitted from a rear end portion of said shroud glass and reaches an inner peripheral face of said front opening of said insulating plug;

wherein said metal light blocking member has a shape of a bottomed cylinder and further comprising a metal supporting member that fixingly supports said shroud glass and is disposed on a front face of said insulating plug;

wherein said metal light blocking member is fixed and integrated with said metal supporting member, or formed integrally with said metal supporting member.

2. The discharge lamp device according to claim 1, wherein said metal light blocking member is coveringly attached to said rear end portion of said shroud glass; and wherein said metal light blocking member includes:

an insertion hole; and an elastic engaging piece formed in a peripheral edge portion of said insertion hole for said rearward elongating portion of said arc tube; and wherein said metal light blocking member is retainingly held by engaging said elastic engaging piece with a constricted portion disposed in a root portion of said rearward elongating portion of said arc tube.

3. The discharge lamp device according to claim 1, wherein said metal supporting member comprises a metal gripping band gripping a portion in a vicinity of said rear end portion of said shroud glass, and wherein said metal light blocking member is coveringly attached to said rear end portion of said shroud glass, and wherein said metal light blocking member is fixed and integrated with said metal gripping band, or formed integrally with said gripping band.

4. The discharge lamp device according to claim 1, wherein said metal supporting member comprises:

a metal gripping band gripping a portion in a vicinity of said rear end portion of said shroud glass; and a metal slide plate for positioning said arc tube body and fixing said gripping band to a front face of said insulating plug; and wherein said metal light blocking member is loosely fitted on said rear end portion of said shroud glass and integrated with said metal slide plate.

5. The discharge lamp device according to claim 1, wherein a base plate of said metal supporting member is fixed to a front face of said insulating plug;

wherein said holding member of said metal supporting member comprises:

a metal gripping band gripping a portion of said shroud glass; and a metal slide plate for positioning said arc tube body and fixing said gripping band to said base plate, and wherein said metal light blocking member is loosely fitted on said rear end portion of said shroud glass and clamped between said metal base plate and said metal slide plate.

6. A discharge lamp device comprising:

an arc tube body including an arc tube having a discharging portion; and a cylindrical shroud glass enclosing said discharging portion and integrated with an arc tube by welding;

an insulating plug made of a synthetic resin and holding a rearward elongating portion of said arc tube in a front opening of said insulating plug, said rearward elongating portion of said arc tube elongating in a rear of said shroud glass;

a metal supporting member fixingly supports said shroud glass and disposed on a front face of said insulating plug; wherein said metal light blocking member is fixed and integrated with said metal supporting member, or formed integrally with said metal supporting member; and a metal light blocking member with a portion interposed between a rear end face of said shroud glass and said front opening of said insulating plug, said light blocking member blocking light which is emitted from a rear end portion of said shroud glass and reaches an inner peripheral face of said front opening of said insulating plug;

wherein said metal light blocking member has a shape of a cylinder extending along an inner peripheral face of said front opening of said insulating plug, said inner peripheral face facing said rear end portion of said shroud glass; and wherein said metal light blocking member is pressingly inserted into said front opening of said insulating plug and retained by said metal supporting member disposed on a front face of said insulating plug to fixingly support a portion in a vicinity of said rear end portion of said shroud glass.

* * * * *